US008385578B2

(12) United States Patent
Onishi et al.

(10) Patent No.: US 8,385,578 B2
(45) Date of Patent: Feb. 26, 2013

(54) PIEZOELECTRIC ACOUSTIC DEVICE AND ELECTRONIC APPARATUS

(75) Inventors: Yasuharu Onishi, Tokyo (JP); Yasuhiro Sasaki, Tokyo (JP); Masatake Takahashi, Tokyo (JP); Ukyo Mori, Tokyo (JP); Jun Kuroda, Tokyo (JP); Nozomi Toki, Saitama (JP); Yukio Yokoyama, Saitama (JP)

(73) Assignee: NEC Corporation, Tokyo (JP)

( * ) Notice: Subject to any disclaimer, the term of this patent is extended or adjusted under 35 U.S.C. 154(b) by 256 days.

(21) Appl. No.: 12/742,369

(22) PCT Filed: Nov. 12, 2008

(86) PCT No.: PCT/JP2008/070587

§ 371 (c)(1),
(2), (4) Date: May 11, 2010

(87) PCT Pub. No.: WO2009/063905

PCT Pub. Date: May 22, 2009

(65) Prior Publication Data

US 2010/0246863 A1 Sep. 30, 2010

(30) Foreign Application Priority Data

Nov. 12, 2007 (JP) ..... 2007-293519

(51) Int. Cl.
*H04R 1/02* (2006.01)

(52) U.S. Cl. ..... 381/390

(58) Field of Classification Search ..... 381/390
See application file for complete search history.

(56) References Cited

U.S. PATENT DOCUMENTS

| | | | | |
|---|---|---|---|---|
| 4,413,198 | A * | 11/1983 | Bost | 310/324 |
| 4,593,160 | A * | 6/1986 | Nakamura | 381/163 |
| 5,386,479 | A * | 1/1995 | Hersh | 381/190 |
| 6,108,429 | A * | 8/2000 | Nakamura et al. | 381/152 |
| 6,130,951 | A * | 10/2000 | Nakamura et al. | 381/337 |
| 6,739,424 | B2 * | 5/2004 | Ogura et al. | 181/145 |
| 7,151,837 | B2 * | 12/2006 | Bank et al. | 381/190 |
| 7,167,570 | B2 * | 1/2007 | Kobayashi | 381/190 |

FOREIGN PATENT DOCUMENTS

| | | | |
|---|---|---|---|
| JP | 61-168971 | A | 7/1986 |
| JP | 02-44499 | A | 3/1990 |
| JP | 04-46798 | A | 4/1992 |
| JP | 06-29300 | A | 4/1994 |
| JP | 9-163498 | A | 6/1997 |
| JP | 09-327091 | A | 12/1997 |
| JP | 11-004495 | A | 1/1999 |
| JP | 2000-140759 | A | 5/2000 |
| JP | 2001-017917 | A | 1/2001 |
| JP | 2001-339791 | A | 12/2001 |
| JP | 2004-312395 | A | 11/2004 |
| JP | 2007-096423 | A | 4/2007 |
| WO | 2007/083497 | A | 7/2007 |

OTHER PUBLICATIONS

International Search Report for PCT/JP2008/070587, mailed Jan. 13, 2009.

* cited by examiner

*Primary Examiner* — Forrest M Phillips

(57) ABSTRACT

A piezoelectric acoustic device comprises: at least two piezoelectric actuators; a support body that supports the at least two piezoelectric actuators; and a signal input unit that drives the at least two piezoelectric actuators at respective arbitrary times. At least one pair of piezoelectric actuators among the at least two piezoelectric actuators is arranged in such a manner that their sound radiation surfaces face each other with a predetermined gap.

14 Claims, 29 Drawing Sheets

PIEZOELECTRIC ACOUSTIC DEVICE AND ELECTRONIC APPARATUS

The present invention is the National Phase of PCT/JP2008/070587, filed Nov. 12, 2008, which is based upon and claims the benefit of the priority of Japanese patent application No. 2007-293519 filed on Nov. 12, 2007, the disclosure of which is incorporated herein in its entirety by reference thereto.

TECHNICAL FIELD

The present invention relates to a piezoelectric acoustic device that generates a sound wave using a piezoelectric element and to an electronic apparatus comprising the piezoelectric acoustic device.

BACKGROUND

Electromagnetic actuators are conventionally used as the driving sources for acoustic devices such as speakers. An electromagnetic actuator is constituted by a permanent magnet and a voice coil, and generates a vibration by the function of the magnetic circuit of a stator using the magnet. Further, electromagnetic speakers generate sound by vibrating a low-rigidity diaphragm such as an organic film fixed on the vibrating part of the electromagnetic actuator.

In recent years, as the demands for mobile telephone devices and notebook-type personal computers have increased, the demands for small-size and low-power consumption actuators increase. However, since electromagnetic actuators need a large amount of current flowing into the voice coil during operation, it is difficult to reduce the power consumption. Moreover, electromagnetic actuators are not structurally suitable for miniaturization. In addition, an electromagnetic actuator must be covered with an electromagnetic shield when used in an electronic apparatus in order to prevent harmful effects caused by a leakage magnetic flux from the voice coil, and it is not suitable for use in small-size electronic apparatuses such as mobile telephones from this reason too. Finally, the voice coil becomes thinner as the size is reduced, and as a result, there is a probability that the voice coil is burn-damaged due to an increase in the resistance value of the wire.

In order to solve the problems above, a piezoelectric actuator having the characteristics of being small, light, power-saving, and no leakage of magnetic flux and having a piezoelectric element such as a piezoelectric ceramic as the driving source has been developed as a thin vibration part that replaces the electromagnetic actuator. The piezoelectric actuator generates a mechanical vibration through the motion of the piezoelectric element, and for instance, it has a configuration in which the piezoelectric ceramic (or simply "piezoelectric element") is joined to a base.

The basic structure and operation of a piezoelectric actuator will be described with reference to FIGS. 58 and 59. FIG. 58 is a schematically exploded perspective view showing the configuration of a piezoelectric actuator in the background technology, and FIG. 59 is a schematic diagram showing how the piezoelectric actuator in FIG. 58 vibrates.

As shown in FIG. 58, the piezoelectric actuator 311 has a piezoelectric element 312 constituted by a piezoelectric ceramic, a base 313, onto which the piezoelectric element 312 is fixed, and a ring-shaped support member 314 that supports the outer peripheral section of the base 313. When an AC voltage is applied to the piezoelectric element 312, the piezoelectric element 312 starts to expand and contract. As shown in FIG. 59, the base 313 deforms into a convex mode (indicated by the solid line) or a concave mode (indicated by the broken line) according to the expansion and contraction movements. As described, the piezoelectric actuator 311 vibrates vertically as shown in the drawing with the joint section between the base 313 and the support member 314 as a fixed end (node) and the center of the base 313 as the anti-node of the vibration.

A piezoelectric actuator can be made thinner, however, in one aspect, an acoustic performance as an acoustic device is inferior to an electromagnetic actuator. This is because the amplitude of a piezoelectric actuator is low at frequencies other than the resonant frequency, although a large amplitude can be obtained from a piezoelectric element at frequencies near the resonant frequency due to its high mechanical Q value and high rigidity, compared to an electromagnetic actuator. Since a low amplitude of an actuator translates into a low sound pressure, this means that a sufficient sound pressure cannot be obtained in a wide frequency band required for music playback. Further, in order to solve a problem that a piezoelectric actuator has a low sound pressure in a frequency band not higher than the fundamental resonant frequency, the sound radiation surface may be enlarged, however, this solution is not preferable when the actuator is built into a mobile electronic apparatus. Meanwhile, for instance, Patent Documents 1 to 7 disclose means for increasing the vibration amplitude of a piezoelectric actuator.

A piezoelectric actuator described in Patent Document 1 comprises a first bimorph and a second bimorph formed shorter than the distance between two support ends of the first bimorph. An end of the second bimorph is fixed on position [sic. one] surface of the first bimorph in an insulated state so that the second bimorph vibrates in the same direction as the thickness of the first bimorph.

In a piezoelectric actuator described in Patent Document 2, the peripheral part of a vibrating body constituted by a piezoelectric body and an elastic body is supported and fixed by a spring structure.

In a piezoelectric actuator described in Patent Document 3, a piezoelectric body is supported by a support member via an elastic member, and a slit is formed inside the elastic portion, between the elastic member and the support member, or between the elastic member and the piezoelectric body.

In a piezoelectric acoustic device described in Patent Document 4, the peripheral part of a piezoelectric vibrator is fixed to the inner circumference of a ring-shaped support member, the outer circumference of the support member is fixed to the peripheral wall of a case, and the support member is constituted by a planar member and has a curved section curving in the thickness direction between the inner circumference and the outer circumference.

An electroacoustic transducer for a parametric speaker described in Patent Document 5 comprises a piezoelectric actuator, a diaphragm, bonded underneath the piezoelectric actuator, that vibrates so as to generate ultrasonic waves along with the flexural vibration of the piezoelectric actuator, and a resonator that resonates the ultrasonic waves generated with the vibration of the piezoelectric actuator, and the resonator has a resonance chamber and a sound output hole that goes through the resonance chamber.

A spherical piezoelectric speaker described in Patent Document 6 comprises a spherical shell type of a piezoelectric ceramic body, which is hollow and is polarized in the thickness direction, an external electrode disposed on the outer surface of the piezoelectric ceramic body, and an internal electrode disposed on the inner surface of the piezoelectric ceramic body, and sound is generated by supplying a drive signal across the external electrode and the internal electrode so that the piezoelectric ceramic body oscillates.

In a piezoelectric sounding body described in Patent Document 7, one end of a piezoelectric vibrating body is supported by a support body on a sound panel, and a vibration transmitting material is fixed between the other free end and the sound panel.

[Patent Document 1] Japanese Patent Kokai Publication No. JP-A-61-168971

[Patent Document 2] Japanese Patent Kokai Publication No. JP-P2000-140759A

[Patent Document 3] Japanese Patent Kokai Publication No. JP-P2001-17917A

[Patent Document 4] Japanese Patent Kokai Publication No. JP-P2001-339791A

[Patent Document 5] Japanese Patent Kokai Publication No. JP-P2004-312395A

[Patent Document 6] Japanese Patent Kokai Publication No. JP-A-9-163498

[Patent Document 7] Japanese Patent Kokai Publication No. JP-P2007-96423A

SUMMARY

The entire disclosures of the aforementioned Patent Documents 1 to 7 are incorporated herein by reference thereto. The following analysis on the related arts is given by the present invention.

The piezoelectric actuators described in Patent Documents 1 to 3 are mainly used in vibrators built into mobile telephone devices and are not designed at all for use in speakers to play back music or audio sound. When a piezoelectric actuator is used as a vibrator, it only needs to amplify the amplitude of limited particular frequencies, however, when it is used as a speaker, the frequency characteristics has to be taken into account. In other words, a sound pressure equal to or greater than a predetermined level must be obtained over a frequency range required for music playback, for instance, 0.2 to 20 kHz.

Since a vibration occurs in both the thickness and diameter directions of the piezoelectric vibrator in the piezoelectric acoustic device described in Patent Document 4, the vibration energy is dispersed and the vibration amount in the sound radiation direction decreases. Therefore, the device needs to be configured so as to be able to obtain a predetermined sound pressure level in the sound radiation direction.

Since the piezoelectric actuator, the diaphragm, and the resonance chamber are layered and joined in the electroacoustic transducer for a parametric speaker described in Patent Document 5, the size in the layer direction inevitably becomes large.

As for the spherical piezoelectric speaker described in Patent Document 6, there is high possibility that the piezoelectric actuator is damaged by the shock of a fall.

Since the piezoelectric vibrating body has a cantilever structure in the piezoelectric sounding body described in Patent Document 7, there is high possibility that the piezoelectric vibrating body is damaged by the shock of a fall.

Since a piezoelectric actuator has high rigidity and a high mechanical Q value, the vibration amount at frequencies near the resonant frequency is large. However, since the amplitude amount decreases in a band outside the resonant frequency, a sufficient sound pressure level can be obtained only at frequencies near the resonant frequency (particularly the fundamental resonant frequency), counted as drawback. Therefore, for a piezoelectric acoustic device using a piezoelectric actuator, it is important not only to increase the sound pressure at particular frequencies, but also how to universally increase the sound pressure in a desired frequency range when a frequency characteristics required as an acoustic device is taken into account.

Further, in order to build a piezoelectric acoustic device using a piezoelectric actuator into a mobile apparatus such as a mobile telephone, it is necessary to increase the stability against shocks without increasing the size.

It is an object of the present invention to provide a piezoelectric acoustic device and electronic apparatus, comprising the acoustic device, capable of providing a high sound pressure and a stable sound pressure in a wide frequency band, and having a small size and great strength.

According to a first aspect of the present invention, there is provided a piezoelectric acoustic device comprising at least two piezoelectric actuators, a support body that supports at least two piezoelectric actuators, and a signal input unit that drives at least two piezoelectric actuators at respective arbitrary times. At least one pair of piezoelectric actuators among at least two piezoelectric actuators is arranged in such a manner that their sound radiation surfaces face each other with a predetermined gap.

According to a preferred mode of the first aspect, the piezoelectric actuator includes at least one plate-like piezoelectric element that expands and contracts along the sound radiation surface, a base joined to one side of the piezoelectric element, and a diaphragm joined to the base and having a lower elasticity and a wider area than the base. The base transmits the expansion/contraction of the piezoelectric element to the diaphragm so as to generate sound waves.

According to a preferred mode of the first aspect, the diaphragm and the support body are joined together.

According to a preferred mode of the first aspect, the piezoelectric actuator further includes a support member joined to an outer periphery of the diaphragm. The support member and the support body are joined together.

According to a preferred mode of the first aspect, the support body includes a plate-like support board(s). At least two piezoelectric actuators and the plate-like support board(s) surround a space defined by at least one pair of piezoelectric actuators facing each other.

According to a preferred mode of the first aspect, the support board has a through hole that leads to the space defined by at least one pair of piezoelectric actuators facing each other.

According to a preferred mode of the first aspect, the piezoelectric acoustic device includes a rectangular parallelepiped formed by the piezoelectric actuators and the support body. At least one pair of piezoelectric actuators is disposed on two facing faces of the rectangular parallelepiped. The piezoelectric actuators or a part of the support body are disposed on the remaining four faces.

According to a preferred mode of the first aspect, at least one pair of piezoelectric actuators have frequency characteristics different from each other.

According to a preferred mode of the first aspect, the piezoelectric actuator is of a bimorph type having at least two piezoelectric elements.

According to a preferred mode of the first aspect, the signal input unit synchronizes the operations of at least two piezoelectric actuators so that a space surrounded by at least two piezoelectric actuators simultaneously expands or contracts.

According to a second aspect of the present invention, there is provided an electronic apparatus comprising a piezoelectric acoustic device. The piezoelectric acoustic device includes at least two piezoelectric actuators, a support body that supports at least two piezoelectric actuators, and a signal input unit that drives at least two piezoelectric actuators at respective arbitrary times. At least one pair of piezoelectric actuators among at least two piezoelectric actuators is arranged in such a manner that their sound radiation surfaces face each other with a predetermined gap.

According to a preferred mode of the second aspect, the electronic apparatus further comprises a case. The piezoelectric acoustic device is built therein so that at least one piezoelectric actuator faces the case.

According to a preferred mode of the second aspect, the electronic apparatus further comprises a case. The piezoelectric acoustic device is built therein so that at least one piezoelectric actuator does not face the case.

According to a preferred mode of the second aspect, the case has at least one through hole that penetrates the case. The support body has a plate-like support board(s) At least two piezoelectric actuators and the plate-like support board surround a space defined by at least one pair of piezoelectric actuators facing each other. The support board has a through hole that leads to the space where at least one pair of piezoelectric actuators facing each other. The piezoelectric acoustic device is built into the electronic apparatus so that the through hole of the case and the through hole of the support board face each other.

The piezoelectric acoustic device of the present invention has at least one of the following effects.

In the piezoelectric acoustic device of the present invention, a plurality of piezoelectric actuators are driven simultaneously. As a result, the sound pressure (particularly the sound pressure in a particular frequency band reproduced by one piezoelectric actuator) can be increased because the piezoelectric acoustic device has a sound radiation area multiple times larger than an acoustic device comprising one piezoelectric actuator. Further, even if one of the piezoelectric actuators is damaged, the function as an acoustic device can be maintained since the other piezoelectric actuator(s) continues to radiate sound. Further, since it becomes possible to reproduce multichannel stereophonic sound with one piezoelectric acoustic device, the convenience as an acoustic device for an electronic apparatus having a function of reproducing music is improved.

In the piezoelectric acoustic device of the present invention, the sound radiation area is increased without greatly increasing the volume by three-dimensionally arranging thin piezoelectric actuators. As a result, the piezoelectric acoustic device of the present invention can be built into a dead space of a small-size mobile telephone.

In the piezoelectric acoustic device of the present invention, a plurality of piezoelectric actuators can be synchronized. As a result, it becomes possible to transmit sound waves with the same wavefront in a plurality of directions, as a so-called pulsating sphere (a sphere that expands/contracts). By having sound waves radiate in a plurality of directions, an acoustic device close to a non-directional and ideal sound source and capable of reproducing the original sound with high fidelity can be realized.

In the present invention, the piezoelectric element and the base are joined to the support body (support member) by the diaphragm. Since the diaphragm is more easily deformed than the base, the vibration amplitude can be increased. As a result, it becomes possible to make the form of the vibration closer to the piston type (the same as the vibration form of the electromagnetic actuator). Further, since the diaphragm can absorb the impact to the piezoelectric acoustic device when it is dropped, damage to, for instance, the piezoelectric element can be avoided.

In the piezoelectric acoustic device of the present invention, piezoelectric actuators having different frequency characteristics and different resonant frequencies can be combined. As a result, the frequency characteristics of the piezoelectric acoustic device can be flattened at a stable sound pressure, and the frequency band can be widened.

According to the electronic apparatus of the present invention, the acoustic effects obtained by the piezoelectric acoustic device of the present invention (for instance, a large sound pressure level and a wide frequency band) can be achieved. Further, due to the downsizing of the piezoelectric acoustic device of the present invention, the electronic apparatus itself can be downsized.

PREFERRED MODES

Modes of the present invention will be described with reference to the drawings. Note that the same symbol is given to the same component in the configuration of each mode described below and the description of it will not be repeated.

Mode 1

Figure 1:
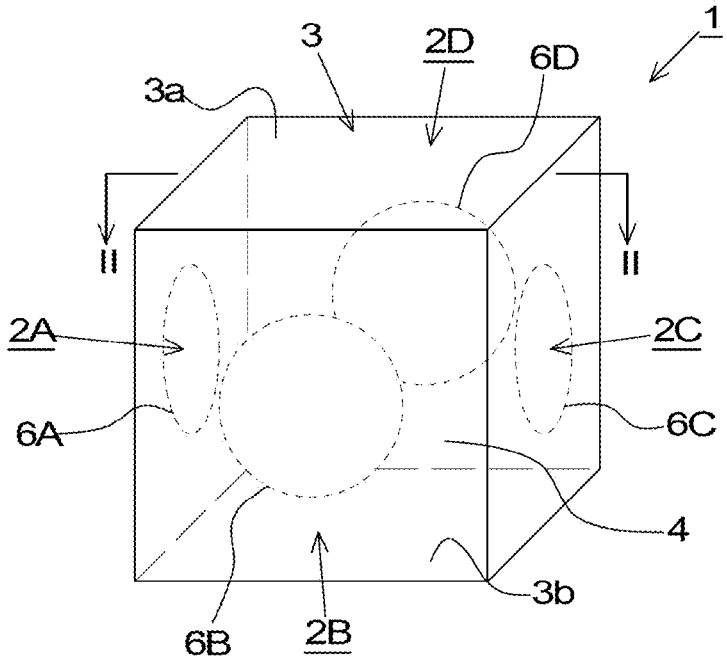
FIG. 1 is a schematic perspective view of a piezoelectric acoustic device according to a first mode of the present invention.
Figure 2:
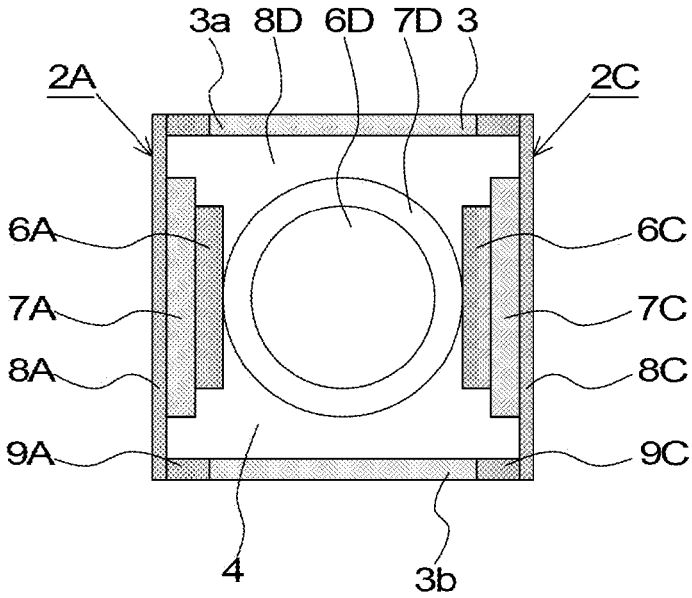
FIG. 2 is a schematic cross-sectional view along line II-II in FIG. 1.

A piezoelectric acoustic device according to a first mode of the present invention will be described. FIG. 1 shows a schematic perspective view of the piezoelectric acoustic device according to the first mode. FIG. 2 shows a schematic cross-sectional view along line II-II in FIG. 1. In FIG. 1, the positions of piezoelectric elements 6A to 6D are indicated by the broken lines.

Figure 3:
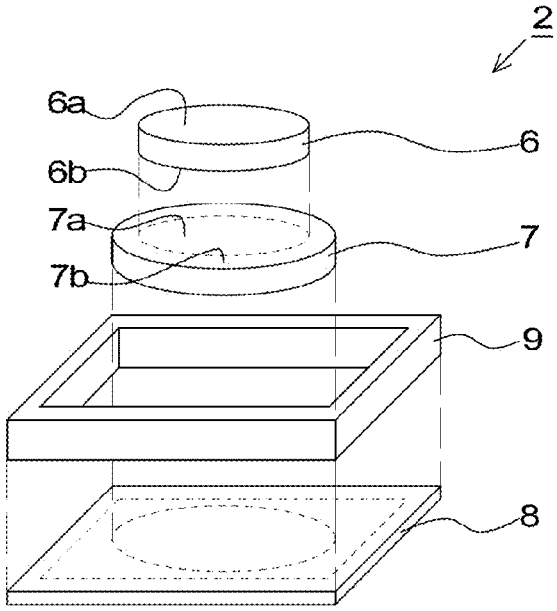
FIG. 3 is an exploded perspective view of a piezoelectric actuator in the piezoelectric acoustic device according to the first mode of the present invention.
Figure 4:
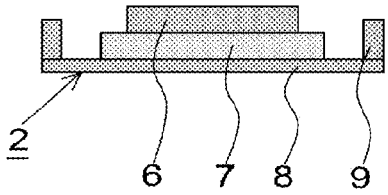
FIG. 4 is a schematic cross-sectional view of the piezoelectric actuator in the piezoelectric acoustic device according to the first mode of the present invention.
Figure 5:
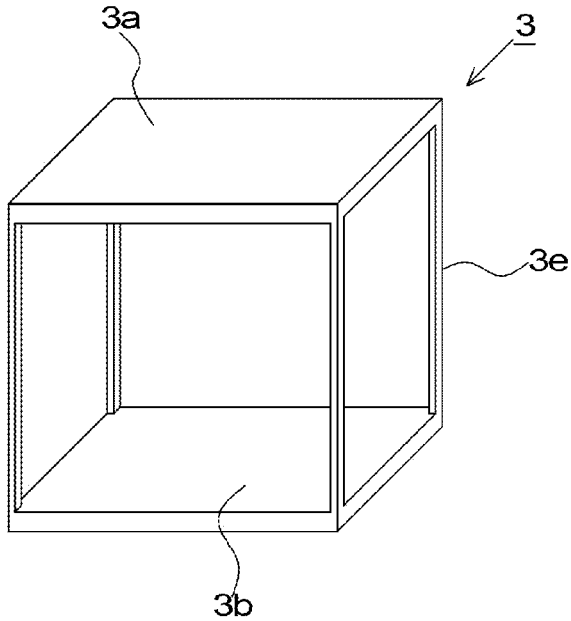
FIG. 5 is a schematic perspective view of a support body in the piezoelectric acoustic device according to the first mode of the present invention.

The piezoelectric acoustic device 1 comprises four piezoelectric actuators 2A to 2D, a support body 3, and a signal input unit (not shown in the drawing). FIG. 3 shows a schematic exploded perspective view of the piezoelectric actuator 2 and FIG. 4 shows a schematic cross-sectional view of the piezoelectric actuator 2. Further, FIG. 5 shows a schematic perspective view of the support body 3.

The piezoelectric actuator 2 comprises the piezoelectric element 6, which is a driving source of vibration, a base 7 that supports the piezoelectric element 6, a diaphragm 8 that supports the base 7, and a support member 9 that surrounds the piezoelectric element 6 and the base 7 and that supports the diaphragm 8. The piezoelectric element 6, the base 7, and the diaphragm 8 are laminated in this order. The piezoelectric element 6 and the base 7 are circular (disk-shaped), the diaphragm 8 is quadrilateral (preferably square), and these three members are disposed so that their centers are aligned (concentrically). The piezoelectric element 6 and the base 7 are preferably disk-shaped, however, their shapes are not limited to this and they may be shaped otherwise. The support member 9 is formed into a quadrilateral (preferably square) frame and is joined to the outer peripheral section of the diaphragm 8.

The signal input unit (not shown in the drawings) capable of driving each piezoelectric actuator at arbitrary timing is connected to each of the piezoelectric actuators 2A to 2D. An upper electrode layer and a lower electrode layer of the signal input unit are connected to each of the piezoelectric elements 6.

The piezoelectric actuators 2A to 2D are arranged in such a manner that at least one pair of piezoelectric actuators have their sound radiation surfaces facing each other with a predetermined gap. In other words, in the first mode, a pair of the piezoelectric actuators 2A and 2C and a pair of the piezoelectric actuators 2B and 2D are arranged so that they respectively have the surfaces of their piezoelectric elements face each other.

The piezoelectric element 6 is constituted by a piezoelectric plate (piezoelectric ceramic body) having two main surfaces 6*a* and 6*b*, and an upper electrode layer and a lower electrode layer (both are not shown in the drawings) are formed on each of the main surfaces 6*a* and 6*b* of the piezoelectric plate. The polarization direction of the piezoelectric plate is not particularly restricted, however, in the present mode, it goes vertically upward in the thickness direction of the piezoelectric element 6 in FIG. 4. The piezoelectric element 6 configured as described expands/contracts in the radial direction (diameter expanding movement) in such a manner that its main surfaces 6*a* and 6*b* simultaneously expand or contract when an AC voltage is applied to the upper electrode layer and the lower electrode layer and an alternating electric field is given. In other words, the piezoelectric element 6 performs a movement in such a manner that it alternates between a first deformation mode in which the main surfaces 6*a* and 6*b* expand and a second deformation mode in which the main surfaces 6*a* and 6*b* contract.

Further, the piezoelectric element 6 may have a layered structure in which piezoelectric material layer(s) and electrode layer(s) are alternately laminated.

The base 7 converts and transmits the expansion/contraction of the piezoelectric element 6 to the diaphragm 8 so as to generate sound waves (so that the diaphragm 8 moves relative to the surface direction). The base 7 is constituted by an elastic body (stretchable material) and it is preferred that a material having a lower elasticity than the ceramic material constituting the piezoelectric element 6, such as a metal material (for instance, aluminum alloy, phosphor bronze, titanium, titanium alloy, or iron-nickel alloy), or a resin material (for instance, epoxy, acrylic, polyimide, polycarbonate, or polyethylene terephthalate) is widely used. Further, it is preferred that the area of the base 7 is wider than that of the piezoelectric element 6.

The main surface 6*b* (the lower electrode layer) of the piezoelectric element 6 is fixed to the top surface of the base 7, and as a result, the piezoelectric element 6 is bound to the base 7. In FIG. 3, a region in the base 7 to which the piezoelectric element 6 is fixed is indicated as a binding section 7*a*, and the other region (surrounding the binding section 7*a*) is indicated as a non-binding section 7*b*.

The diaphragm 8 is a membrane material for generating sound and for amplifying the vibration amplitude of the piezoelectric actuator 2, and has a lower elasticity than the base 7. An example of the material combination for the base 7 and the diaphragm 8 may be a metal material for the base 7 and a resin material for the diaphragm 8 (for instance, urethane, polyethylene terephthalate (PET), polyethylene, and polyethylene film). Or the base 7 and the diaphragm 8 may be constituted by the same material, and the diaphragm 8 may be made relatively less elastic by making the film thickness of the diaphragm 8 relatively thinner than that of the base 7. Further, other than the materials mentioned above, paper may be used for the diaphragm 8. It is preferred that the thickness of the diaphragm 8 is, for instance, not thinner than 5 μm and not thicker than 500 μm when a resin material is used. Particularly, when the diaphragm 8 is a flat sheet material, the thickness should preferably be not thinner than 5 μm and not thicker than 180 μm. Further, it is preferred that Young's modulus (the modulus of longitudinal elasticity) is used when the elastic moduli of the diaphragm 8 and the base 7 are compared. At this time, it is preferred that each elastic modulus is measured in compliance with JISZ2280.

The diaphragm 8 also has the function of amplifying the vibration amplitude of the piezoelectric actuator, in addition to the function as a vibration film for generating sound. Further, since the piezoelectric element 6 and the base 7 are attached to the support member 9 (or the support body 3) via the diaphragm 8, even if the piezoelectric acoustic device is dropped, damage to the piezoelectric element 6 can be suppressed because the diaphragm 8 can absorb the shock.

The material of the support member 9 is not particularly restricted, and it may be a resin material or a metal material.

For instance, an epoxy adhesive can be used for joining the piezoelectric element 6 and the base 7 and for joining the base 7 and the diaphragm 8. The thickness of the adhesive layer is not particularly restricted, however, it should preferably be not thicker than, for instance, 20 μm since the vibration energy absorbed by the adhesive layer will increase and a sufficient vibration amplitude cannot be possibly obtained if the adhesive layer is too thick.

The support body 3 joins the piezoelectric actuator 2 to form the piezoelectric acoustic device 1. The support body 3 is a rectangular parallelepiped (for instance a cube), and supporting boards 3*a* and 3*b* are respectively formed on a pair of facing surfaces. In other words, the support body 3 is formed by respectively connecting the facing vertices of the two quadrilateral (for instance square) support boards 3*a* and 3*b* with support frame members 3*e*. The piezoelectric acoustic device 1 is formed by respectively attaching the piezoelectric actuators 2A to 2D to the four openings of the support body 3 formed by the support boards 3*a* and 3*b* and the four support frame members 3*e*. The material of the support body 3 is not particularly restricted, and it may be a resin or metal material. Further, the material of the support body 3 may be the same material as that of the support member 9 constituting the piezoelectric actuator 2, or the support member 9 and the support body 3 may be integrated as described in other modes later.

For instance, an epoxy adhesive can be used for joining the piezoelectric actuator 2 and the support body 3. The thickness of the adhesive layer is not particularly restricted, however, it should preferably be not thinner than, for instance, 10 μm since a gap may occur in the bonding section and a leak from the gap may occur when sound waves radiate if it is too thin.

The piezoelectric acoustic device 1 is constituted by respectively joining the piezoelectric actuators 2A to 2D to the four openings of the support body 3. In the piezoelectric acoustic device 1, a space 4 is formed by the four piezoelectric actuators 2A to 2D and the two support boards 3*a* and 3*b*. The capacity of the space 4 is not particularly restricted, however, the interval between the facing piezoelectric actuators 2A and 2C or 2B and 2D should preferably be not less than, for instance, 0.25 mm since the piezoelectric actuators 2 may contact each other during the operation of the piezoelectric actuators 2 if the intervals are too short. Further, the space 4 is not limited to a space shielded by the piezoelectric actuators 2A to 2D and the support body 3, and an opening may be formed in the support body 3 as described in other modes later. By forming this opening, air resistance from the space 4 occurring during the operation of the piezoelectric actuator 2 is suppressed and favorable acoustic characteristics can be realized.

Figure 6:
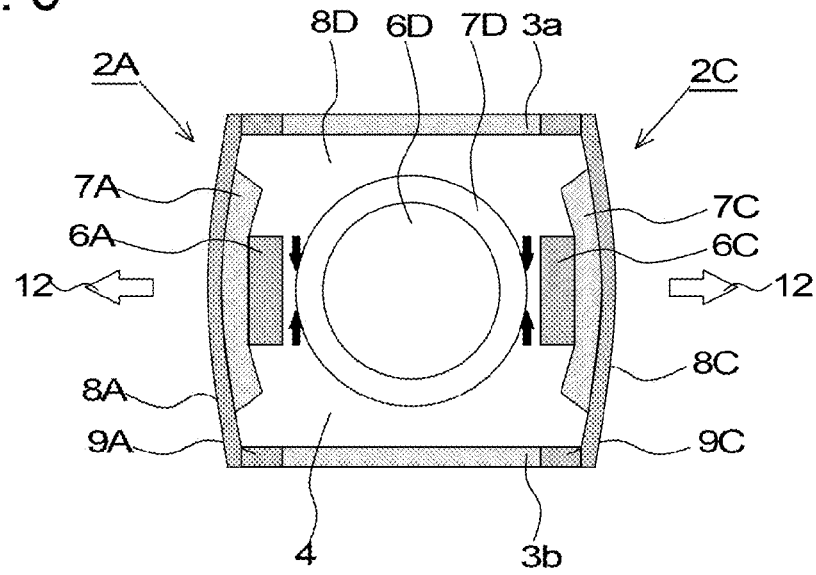
FIG. 6 is a schematic cross-section view for explaining the operation of the piezoelectric acoustic device according to the first mode of the present invention.
Figure 7:
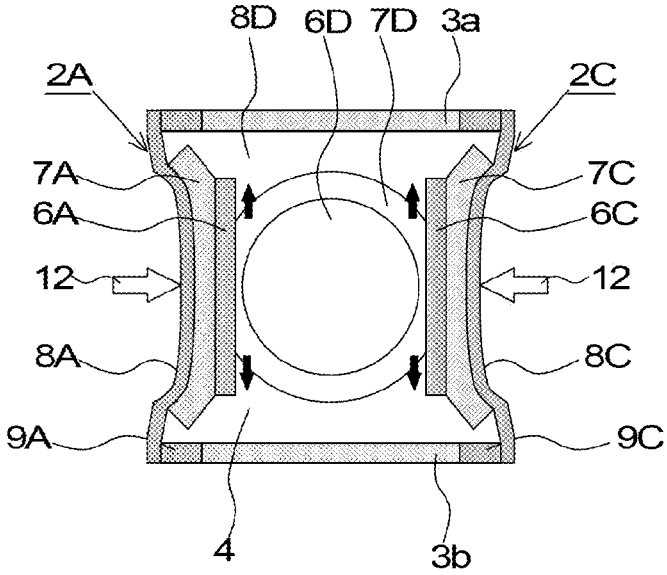
FIG. 7 is a schematic cross-section view for explaining the operation of the piezoelectric acoustic device according to the first mode of the present invention.

FIGS. 6 and 7 show schematic cross-sectional views for explaining the operation of the piezoelectric acoustic device according to the first mode. In the piezoelectric acoustic device 1, the plurality of piezoelectric actuators 2A to 2D are simultaneously driven. The driving conditions for each of the piezoelectric actuators 2A to 2D are not particularly restricted and drive voltages and phases different from each other may be used, however, it is preferred that the actuators are driven by the same drive voltage so as to have (positive) phases identical to each other as shown in FIGS. 6 and 7. In other words, it is preferred that the piezoelectric actuators 2A to 2D operate in synchronization so that vibration directions (sound radiating directions) 12 are symmetrical, and more concretely, it is preferred that the piezoelectric actuators 2A to 2D simultaneously expand the space 4 (toward the outside of the piezoelectric acoustic device 1) (FIG. 6) and simultaneously contract the space 4 (toward the inside of the piezoelectric acoustic device 1) (FIG. 7). As described, by driving the actuators so that the phases are matched to each other, it becomes possible to transmit sound waves with the same wavefront in four directions as a pulsating sphere, i.e., a sphere that expands/contracts by pulsating. As a result, a non-directional ideal sound source can be realized and sound with high fidelity to the original can be reproduced. Further, a large sound pressure can be achieved because sound is radiated from four radiation surfaces, which means that the area of the sound radiation surface becomes four times as large. Note that the deformation of the corner edges of the diaphragms 8A and 8C, for example, is exaggerated in FIGS. 6 and 7 for the sake of illustration.

As described, by three-dimensionally arranging the four piezoelectric actuators 2A to 2D, the area of the sound radiation surfaces can be enlarged for the entire acoustic device without increasing the space for one sound radiating direction and it becomes possible to build the device into a small-size mobile apparatus.

Further, in the piezoelectric acoustic device 1 according to the first mode, the configurations of the piezoelectric actuators 2A to 2D are not particularly restricted and four differently configured piezoelectric actuators may be used. Neither are their shapes particularly restricted; for instance, square and rectangular piezoelectric actuators may be used in combination.

Mode 2

Figure 8:
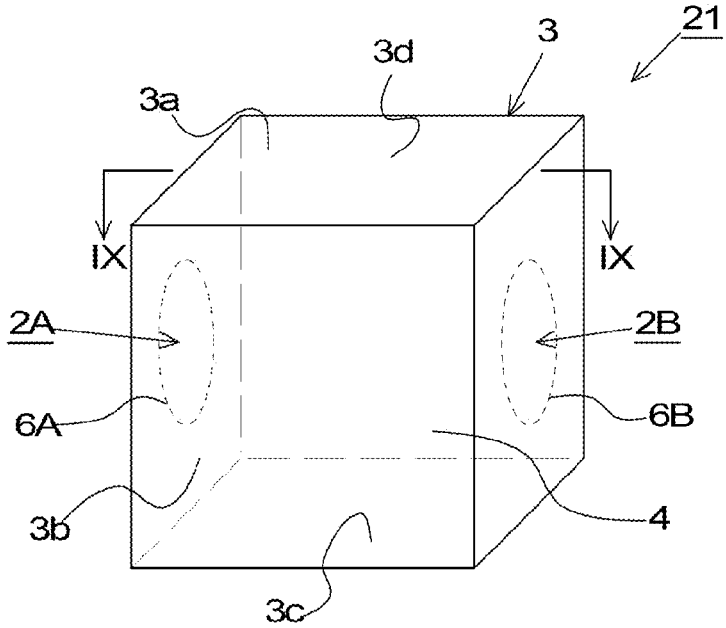
FIG. 8 is a schematic perspective view of a piezoelectric acoustic device according to a second mode of the present invention.
Figure 9:
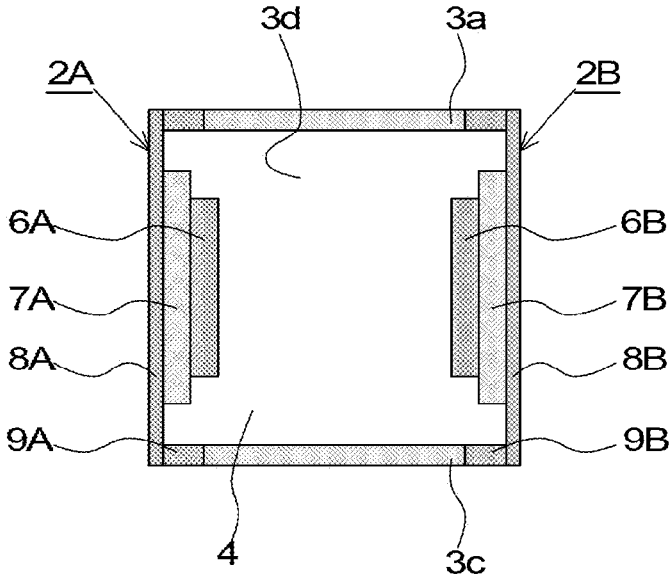
FIG. 9 is a schematic cross-sectional view along line IX-IX in FIG. 8.

Next, a piezoelectric acoustic device according to a second mode of the present invention will be described. FIG. 8 shows a schematic perspective view of the piezoelectric acoustic device according to the second mode, and FIG. 9 shows a schematic cross-sectional view along line IX-IX in FIG. 8. In the first mode, the piezoelectric acoustic device 1 has the four piezoelectric actuators 2A to 2D, whereas, in the second mode, the piezoelectric acoustic device has two piezoelectric actuators 2A and 2B. The piezoelectric actuators 2A and 2B are arranged so that their sound radiation surfaces face each other. In other words, in the rectangular parallelepiped (or cube-shaped) piezoelectric acoustic device 21, the piezoelectric actuators 2A and 2B are disposed on two facing surfaces, and the other four surfaces are support boards 3*a* to 3*d* of the support body 3. Other than this, the second mode is identical to the first mode. The support body 3 may be cylindrical, and in this case, the piezoelectric actuators 2A and 2B can be disposed on a pair of facing (opposing) end surfaces of the cylinder.

According to the second mode, the interval between the piezoelectric actuators 2A and 2B can be set at will. By shortening the interval between the piezoelectric actuators 2A and 2B, the thickness of the sound radiating direction can be reduced and the piezoelectric acoustic device 21 can be made thinner. Further, by adjusting the interval between the piezoelectric actuators 2A and 2B or forming a sound hole as described later, the acoustic characteristics (for instance, the frequency characteristics, sound pressure level, etc.) of the piezoelectric acoustic device 21 can be changed.

Mode 3

Figure 10:
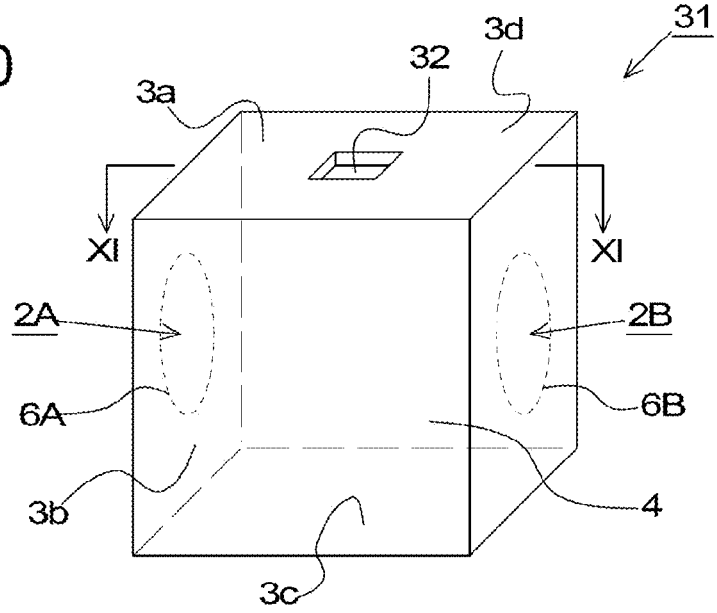
FIG. 10 is a schematic perspective view of a piezoelectric acoustic device according to a third mode of the present invention.
Figure 11:
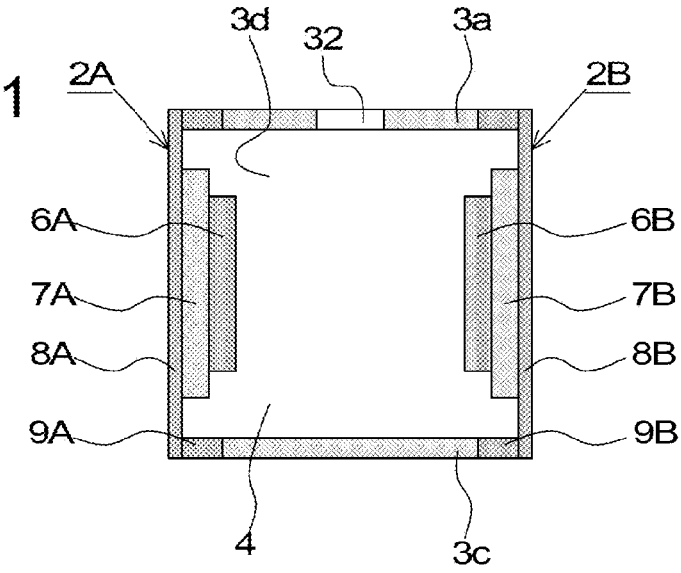
FIG. 11 is a schematic cross-sectional view along line XI-XI in FIG. 10.

Next, a piezoelectric acoustic device according to a third mode of the present invention will be described. FIG. 10 shows a schematic perspective view of the piezoelectric acoustic device according to the third mode, and FIG. 11 shows a schematic cross-sectional view along line XI-XI in FIG. 10. The piezoelectric acoustic device 31 has two piezoelectric actuators facing each other as in the second mode, however, the third mode differs from the second mode in that a through hole (sound hole) 32 that leads to the space 4 is formed on one of the support boards (3*a*) of the support body 3. The sound hole 32 functions as an opening through which sound waves are transmitted. The support board 3*a* on which the sound hole 32 is formed faces a space that the piezoelectric actuators 2A and 2B also face. The sound hole 32 should preferably be formed in the center of the support board 3*a*. The shape and the number of the sound hole(s) 32 are not particularly restricted. There may be a plurality of sound holes and the sound hole may have any shape such as rectangle or circle. Further, the size of the sound hole 32 is not restricted as long as it is within the range of the support board 3*a*, and it can be set appropriately according to the desired acoustic performance.

In the present mode, by simultaneously driving the piezoelectric actuators 2A and 2B at the same phase, it becomes possible to transmit sound waves with the same wavefront from three directions, i.e., from each sound radiation surface of the piezoelectric actuators 2A and 2B, and the sound hole 32 leading to the space 4 and formed on the support board 3*a*. As a result, a non-directional ideal sound source can be realized and sound with high fidelity to the original can be reproduced. Further, the sound pressure level can be increased by letting the sound radiate from two radiation surfaces, enlarging the area of the sound radiation surface twice as much. Further, the sound pressure may increase even more because of interferences between the sound waves radiated from the sound hole 32 of the support board 3*a* and the sound waves radiated from the piezoelectric actuators 2A and 2B having the same phase.

In the piezoelectric acoustic device 31, by simultaneously driving the piezoelectric actuators 2A and 2B at the same phase while matching the amplitude directions relative to the sound radiation surfaces, the sound pressure radiated from the sound hole 32 can be increased.

Mode 4

Figure 12:
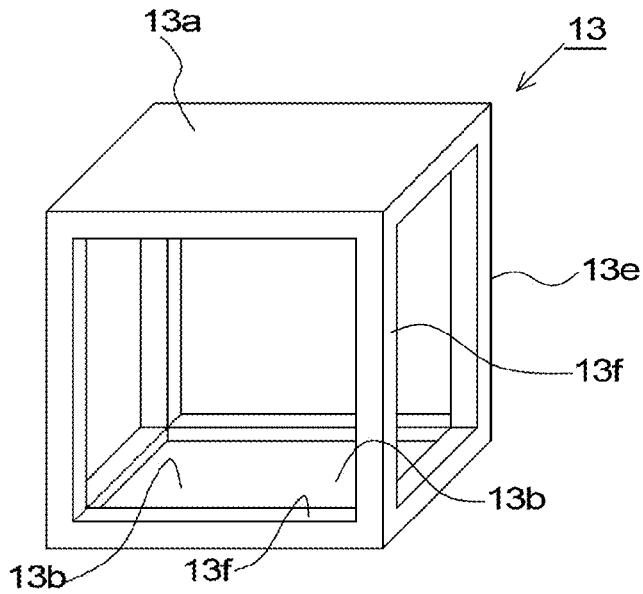
FIG. 12 is a schematic perspective view of a piezoelectric acoustic device according to a fourth mode of the present invention.
Figure 13:
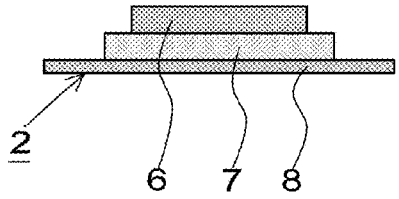
FIG. 13 is a schematic cross-sectional view of a piezoelectric actuator in the piezoelectric acoustic device according to the fourth mode of the present invention.
Figure 14:
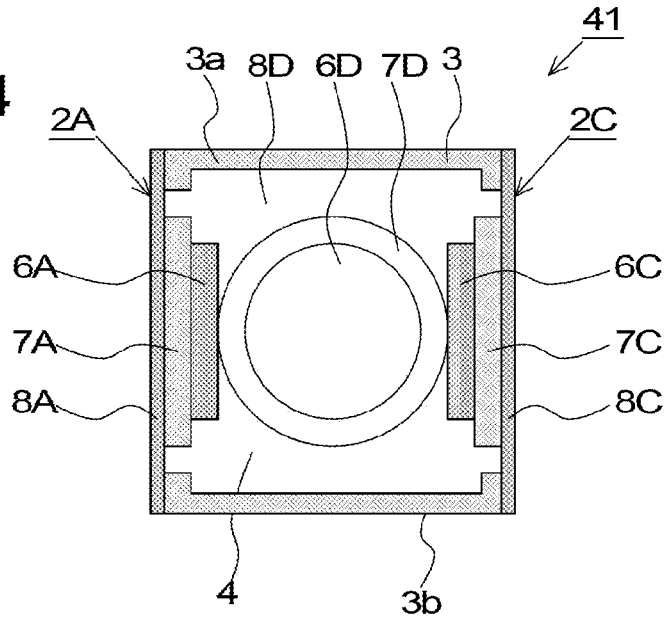
FIG. 14 is a schematic cross-sectional view of the piezoelectric acoustic device according to the fourth mode.

Next, a piezoelectric acoustic device according to a fourth mode of the present invention will be described. FIG. 12 shows a schematic perspective view of a support body according to the fourth mode, and FIG. 13 shows a schematic cross-sectional view of a piezoelectric actuator according to the fourth mode. Further, FIG. 14 shows a schematic cross-sectional view of the piezoelectric acoustic device according to the fourth mode. In the fourth mode, the support member and the support body are formed as one body. In other words, the support body functions as the support member as well. In the support body 13 shown in FIG. 12, a support member 13*f* is formed as a frame integrally with the outer circumferences of the support boards 13*a* and 13*b*, and a support member 13*f* is also formed integrally with support frame members (or sections) 13*e* connecting the support boards 13*a* and 13*b*. As shown in FIG. 13, the piezoelectric actuator 2 attached to this support body 13 does not have a support member discrete from the support body. As described, by forming the support member 13*f* integrally with the support body 13, a gap is prevented from forming in the bonding section between the support member 13*f* and the support body 13, the bonding process is eliminated, and production stability will increase.

The present mode is an application based on the first mode, however, it can be based on the other modes.

Mode 5

Figure 15:
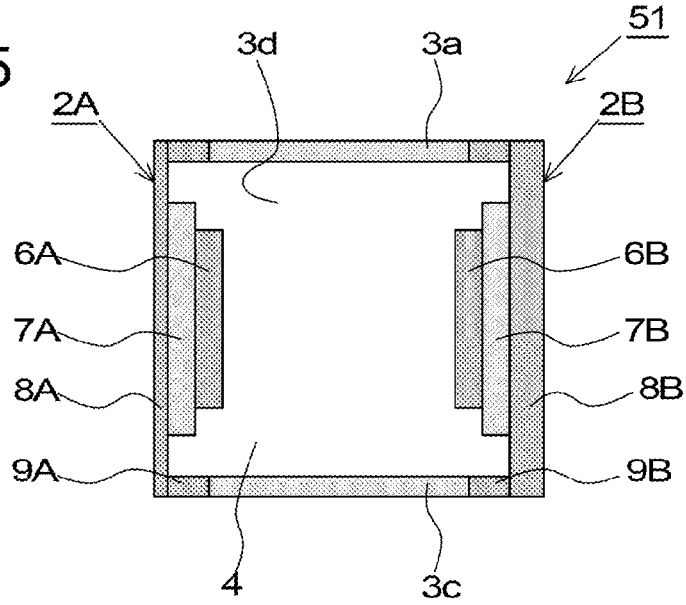
FIG. 15 is a schematic cross-sectional view of a piezoelectric acoustic device according to a fifth mode of the present invention.

Next, a piezoelectric acoustic device according to a fifth mode of the present invention will be described. FIG. 15 shows a schematic cross-sectional view of the piezoelectric acoustic device according to the fifth mode. In the fifth mode, the piezoelectric acoustic device 51 has two piezoelectric actuators 2A and 2B having different fundamental resonant frequencies. As means for making the fundamental resonant frequencies different, for instance, the piezoelectric actuators 2A and 2B respectively use diaphragms 8A and 8B having different film thicknesses. Note that means for making the fundamental resonant frequencies of the piezoelectric actuators different is not particularly restricted in the present mode, and it may be achieved by changing the materials constituting the piezoelectric actuators, or changing the shapes of the piezoelectric actuators, e.g., combining different shapes such as a circle and a square. As described, by configuring the device with the piezoelectric actuators having different fundamental resonant frequencies from each other, it becomes possible to complement the band(s) having low sound pressure level(s) with each other, flattening the frequency characteristics. Further, a piezoelectric acoustic device capable of providing a high sound pressure level in a reproduction frequency band can be realized.

The present mode is an application based on the second mode, however, it can be based on the other modes.

Mode 6

Figure 16:
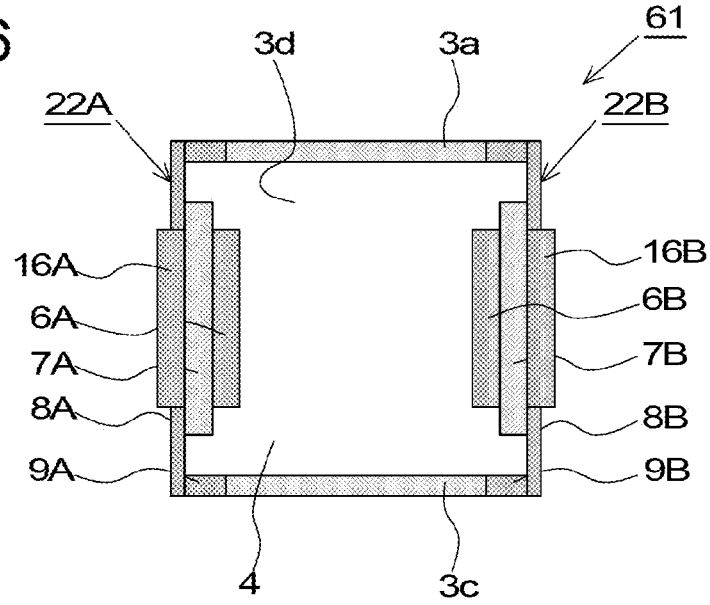
FIG. 16 is a schematic cross-sectional view of a piezoelectric acoustic device according to a sixth mode of the present invention.

Next, a piezoelectric acoustic device according to a sixth mode of the present invention will be described. FIG. 16 shows a schematic cross-sectional view of the piezoelectric acoustic device according to the sixth mode. In the sixth mode, a bimorph piezoelectric actuator is used as the piezoelectric actuator. For instance, a piezoelectric actuator 22A has piezoelectric elements 6A and 16A on both surfaces of a base 7A. An upper electrode layer and a lower electrode layer (both are not shown in the drawings) are respectively connected to both surfaces of the piezoelectric elements 6A and 16A. A through hole is formed on the diaphragm 8A, and the piezoelectric element 16A is inserted to the diaphragm 8A in such a manner that the piezoelectric element 16A is exposed.

The present mode is an application based on the second mode, however, it can be based on the other modes.

Mode 7

Figure 17:
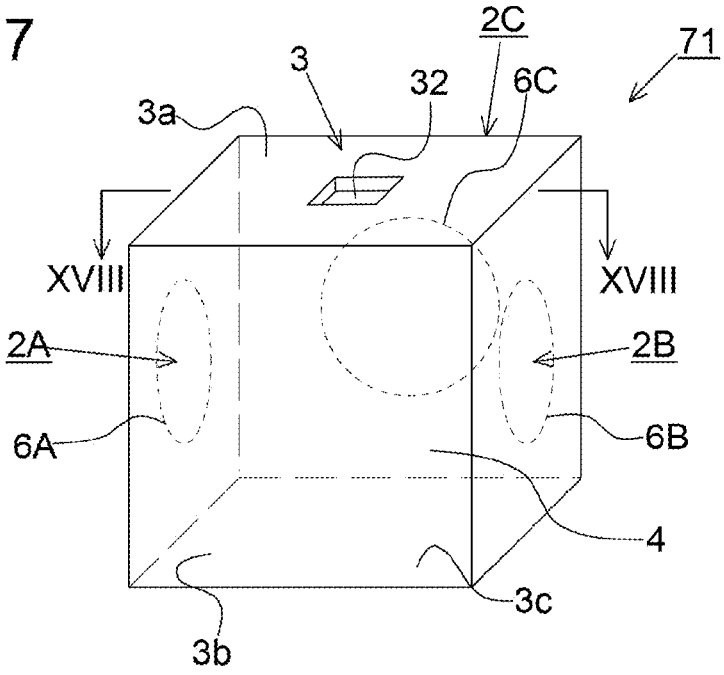
FIG. 17 is a schematic perspective view of a piezoelectric acoustic device according to a seventh mode of the present invention.
Figure 18:
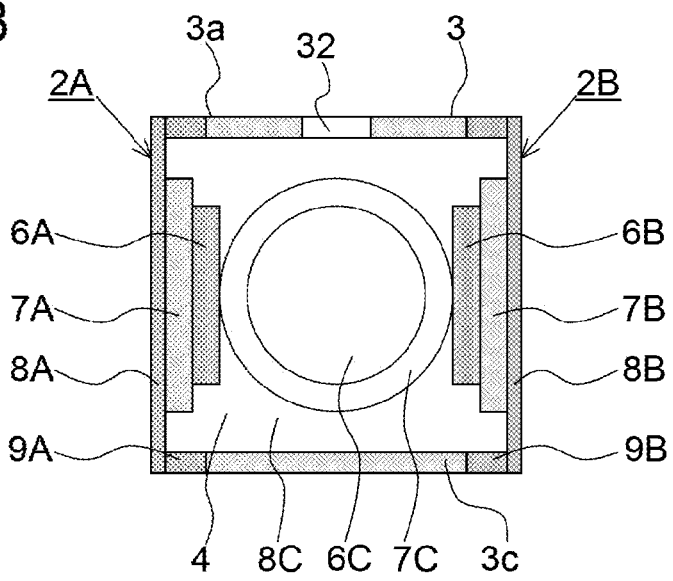
FIG. 18 is a schematic cross-sectional view along line XVIII-XVIII in FIG. 17.

Next, a piezoelectric acoustic device according to a seventh mode of the present invention will be described. FIG. 17 shows a schematic perspective view of the piezoelectric acoustic device according to the seventh mode, and FIG. 18 shows a schematic cross-sectional view along line XVIII-XVIII in FIG. 17. In the seventh mode, the piezoelectric acoustic device 71 has three piezoelectric actuators 2A, 2B, and 2C, and the sound hole 32 is formed on the support board 3*a*. The piezoelectric actuators 2A and 2B are arranged so that their sound radiation surfaces face (oppose) each other. In other words, in the rectangular parallelepiped (or cube-shaped) piezoelectric acoustic device 71, the piezoelectric actuators 2A and 2B are disposed on two facing surfaces. The piezoelectric actuator 2C is disposed perpendicularly to the piezoelectric actuators 2A and 2B. The other three surfaces are the support boards 3*a* to 3*c*, and the sound hole 32 is formed on the support board 3*a* disposed perpendicular to the piezoelectric actuators 2A, 2B, and 2C. The other configuration is identical to the third mode. The support body 3 may be cylindrical, and in this case, the piezoelectric actuators 2A and 2B can be disposed on a pair of facing end surfaces of the cylinder.

According to the seventh mode, the interval between the piezoelectric actuators 2A and 2B can be set at will. By shortening the interval between the piezoelectric actuators 2A and 2B, the thickness of the sound radiating direction can be reduced and the piezoelectric acoustic device 71 can be made thinner. Further, by adjusting the interval between the piezoelectric actuators 2A and 2B, and adjusting the shape and size of the sound hole, the acoustic characteristics (for instance, the frequency characteristics, sound pressure level, etc.) of the piezoelectric acoustic device 71 can be changed.

Mode 8

Figure 19:
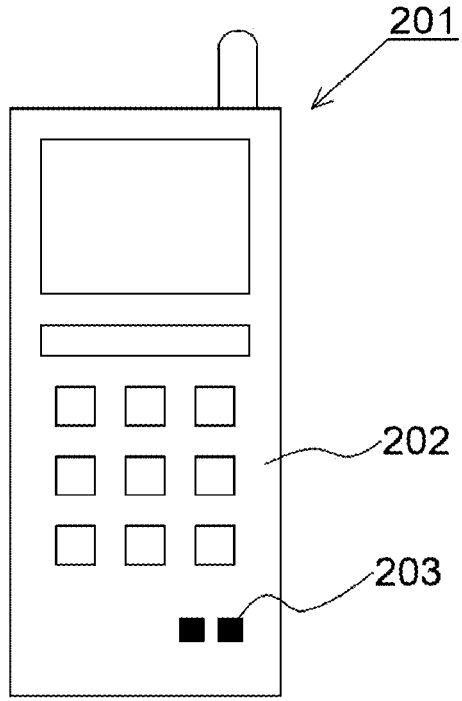
FIG. 19 is a schematic plan of a mobile telephone as an example of an electronic apparatus according to an eighth mode of the present invention.

Next, an electronic apparatus according to an eighth mode of the present invention will be described. The electronic apparatus of the present invention comprises a piezoelectric acoustic device, such as the ones described in the first to the seventh modes. FIG. 19 shows a schematic plan of a mobile telephone as an example of the electronic apparatus of the present invention. For instance, the piezoelectric acoustic device can be attached to the inner surface of a case 202 of the mobile telephone 201, which is the electronic apparatus. At this time, it is preferred that at least one through hole (sound hole) 203 that penetrates the case from the outside to the inside is formed on the case part to which the piezoelectric acoustic device is attached. The shape, the size, and the number of the sound hole(s) on the case can be appropriately set according to the desired acoustic performance. The electronic apparatus of the present invention may be any electronic apparatus as long as the piezoelectric acoustic device of the present invention can be built therein, and examples other than mobile telephones may include mobile apparatuses such as notebook personal computers.

Figure 20:
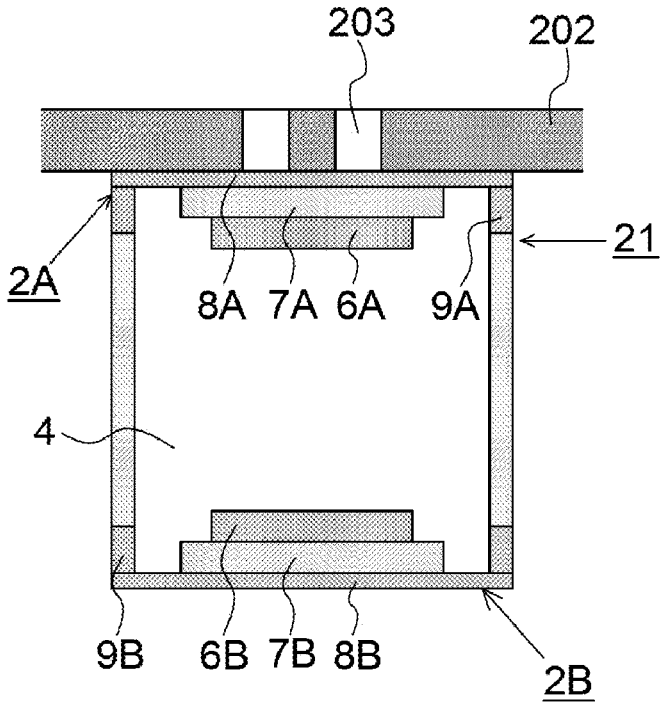
FIG. 20 is a schematic partial cross-sectional view showing a state in which a piezoelectric acoustic device is joined to the case of the electronic apparatus in the eighth mode of the present invention.
Figure 21:
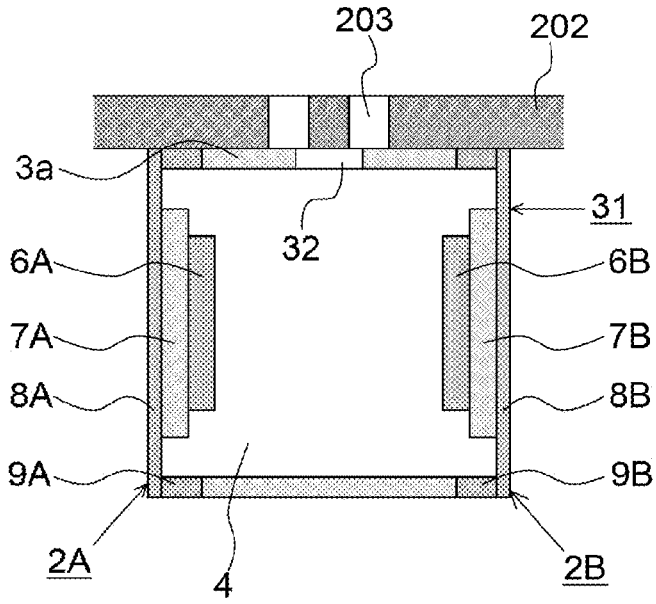
FIG. 21 is a schematic partial cross-sectional view showing a state in which the piezoelectric acoustic device is joined to the case of the electronic apparatus in the eighth mode of the present invention.

FIGS. 20 and 21 are schematic partial cross-sectional views showing states in which the piezoelectric acoustic device is joined to the case of the mobile telephone. For instance, as shown in FIG. 20, the piezoelectric acoustic device 21 can be joined to the mobile telephone 201 using an adhesive so that the diaphragm 8A of the piezoelectric actuator 2A, one of the piezoelectric actuators of the piezoelectric acoustic device 21, faces the inner surface (preferably the sound hole 203) of the case 202 of the mobile telephone 201. In another configuration, as shown in FIG. 21, the piezoelectric acoustic device 31 can be joined to the mobile telephone 201 using an adhesive so that the support board 3*a*, one of the support boards of the piezoelectric acoustic device 31, faces the inner surface (preferably the sound hole 203) of the case 202 of the mobile telephone 201.

In a case where the piezoelectric acoustic device 21 does not have any sound hole as in the first and the second modes, it is preferred that the piezoelectric acoustic device 21 is mounted in such a manner that the diaphragm 8A of the piezoelectric actuator 2A faces the case 202 of the electronic apparatus 201, as shown in FIG. 20. Particularly, when the sound hole 203 is formed on the case 202 of the electronic apparatus 201, it is preferred that the piezoelectric acoustic device 21 is mounted in such a manner that the diaphragm faces the sound hole of the case. Further, as shown in FIG. 20, in a case where the piezoelectric acoustic device 21 is joined to the mobile telephone 201 in such a manner that the piezoelectric actuator 2A and the case 202 face each other, it is preferred that the freedom of the diaphragm 8A is maintained by joining only the perimeter of the piezoelectric actuator 2A to the case.

Further, in a case where the piezoelectric acoustic device 31 has a sound hole as in the third mode, it is preferred that the piezoelectric acoustic device 31 is mounted in such a manner that the support board 3*a*, on which the sound hole 32 is formed, faces the case 202 of the electronic apparatus 201, as shown in FIG. 21. Particularly, when the sound hole (through hole) 203 is formed on the case 202 of the electronic apparatus 201, it is preferred that the piezoelectric acoustic device 31 is mounted in such a manner that the sound hole 32 of the piezoelectric acoustic device 31 faces the sound hole 203 of the electronic apparatus 201. By doing this, sound waves can be effectively generated from the sound hole 203. Further, by controlling the drive signal so that stereophonic sound can be reproduced using two piezoelectric actuators 2A and 2B, two channels can be reproduced using one acoustic device and three-dimensional sound such as stereophonic sound can be realized. This eliminates the need to provide a plurality of speakers, makes the reduction of the mounting area possible, and facilitates the downsizing of the electronic apparatus.

Figure 22:
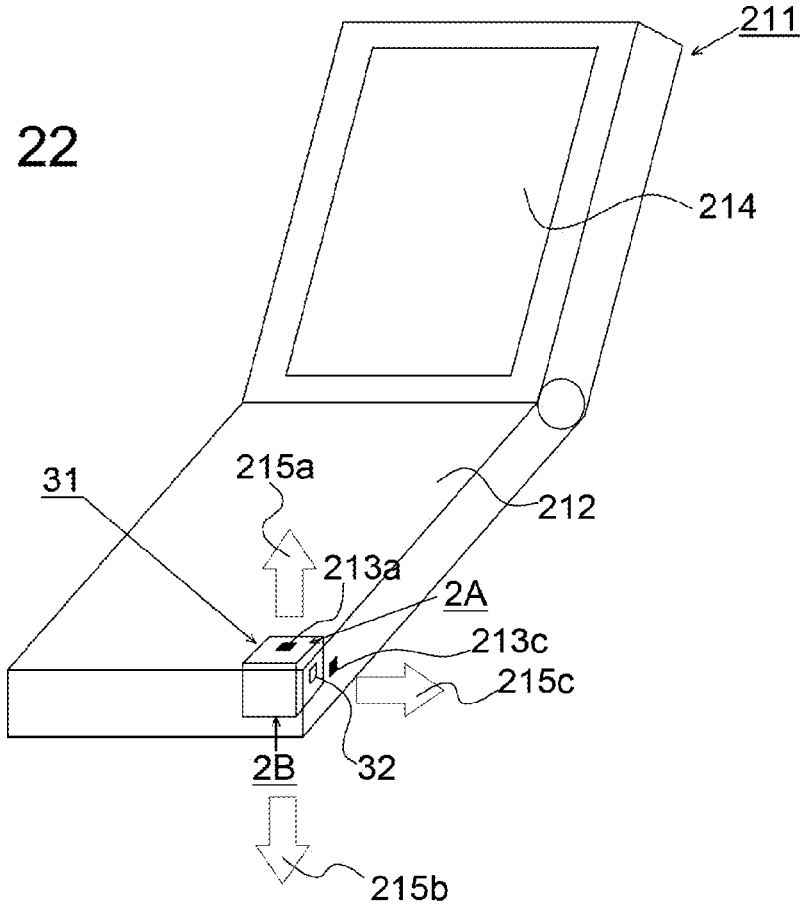
FIG. 22 is a schematic perspective view of the electronic apparatus having the piezoelectric actuator built therein in the eighth mode of the present invention.
Figure 23:
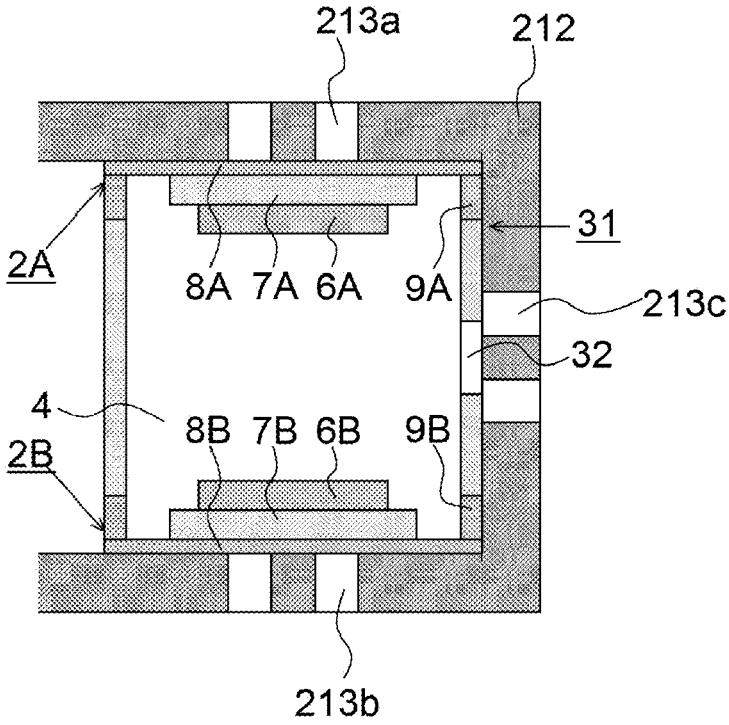
FIG. 23 is a schematic partial cross-sectional view showing a state in which the piezoelectric acoustic device is joined to the case of the electronic apparatus in the eighth mode of the present invention.

FIG. 22 shows a schematic transparent view of a foldable mobile telephone having the piezoelectric actuator built therein. FIG. 23 is a schematic partial cross-sectional view showing a state in which the piezoelectric acoustic device is joined to the case of the mobile telephone. When the piezoelectric acoustic device 31 has the sound hole 32 as in the third mode, the piezoelectric acoustic device 31 can be mounted in such a manner that the diaphragms 8A and 8B of the piezoelectric actuators 2A and 2B face the case 212 of the electronic apparatus (foldable mobile telephone) 211, as shown in FIG. 23. Particularly, when first to third sound holes 213*a* to 213*c* are formed on the front, rear and side surfaces of the case 212 of the electronic apparatus 211, the piezoelectric acoustic device 31 may be mounted in such a manner that the diaphragm 8A faces the first sound hole 213*a*, the diaphragm 8B faces the second sound hole 213*b*, and the sound hole 32 faces the third sound hole 213*c*. By mounting the piezoelectric acoustic device 31 as described, it becomes possible to have sound waves radiate from three different directions: the sound radiation surfaces 8A and 8B of the piezoelectric actuators 2A and 2B, and the sound hole 32, i.e., the front, rear, and side surfaces of the case 212. For instance, a user sometimes opens a foldable mobile telephone such as the one shown in FIG. 22 and watches television in the open state. In this case, the user can listen to sound in synchronization with the picture of the display 214 with no sense of discomfort because sound wave radiation 215*a* comes from the same direction (the front) as the surface direction of a display 214. Further, by controlling the drive signal so that stereophonic sound can be reproduced using two piezoelectric actuators 2A and 2B, two channels can be reproduced using even one acoustic device and three-dimensional sound such as stereophonic sound can be realized. This eliminates the need to provide a plurality of speakers, makes the reduction of the mounting area possible, and facilitates the downsizing of the electronic apparatus. Meanwhile, when the electronic apparatus 211 is closed, the sound hole 213 of the electronic apparatus 211 is blocked, however, the ringtones can be generated by sound wave radiation 215*b* from the rear surface and sound wave radiation 215*c* from the side surface without decreasing the sound pressure level.

Characteristic evaluation tests of the piezoelectric acoustic device of the present invention were performed on Examples 1 to 48. Further, comparison tests were performed on Comparative Examples 1 to 3. Test results are shown in Tables 1 to 4.

Example 1

As a piezoelectric acoustic device according to Example 1, the piezoelectric acoustic device 1 according to the first mode and comprising four piezoelectric actuators 2A to 2D, as shown in FIG. 1, was manufactured. Each of the piezoelectric actuators 2A to 2D was configured as shown in FIGS. 3 and 4. The piezoelectric element 6 was a piezoelectric plate having an outer diameter of ϕ16 mm and a thickness of 50 μm (0.05 mm), and an upper electrode layer and a lower electrode layer, each having a thickness of 8 μm, were formed on the both surfaces. The base 7 was formed with a phosphor bronze having an outer diameter of ϕ18 mm and a thickness of 30 μm (0.03 mm). The diaphragm 8 was formed with a urethane film having a length and width of 21 mm by 21 mm and a thickness of 80 μm. The support member 9 was formed with a SUS304 having a length and width (outer circumference) of 21 mm by 21 mm, a length and width (inner circumference) of 20 mm by 20 mm, and a thickness (height) of 0.5 mm. The support body 3 was a cube having a length, width, and depth of 21 mm by 21 mm by 21 mm, and was formed with a SUS304 having a thickness of 0.5 mm. An opening having a length and width of 20 mm by 20 mm was formed on each of the six surfaces of the cube, except for a pair of facing surfaces. The piezoelectric element 6 and the base 7 were disposed concentrically in the center of the diaphragm 8. Lead-zirconate-titanate ceramic was used for the piezoelectric plate, and silver/palladium alloy (the weight ratio: 70%:30%) was used for the electrode layers. The piezoelectric element 6 was manufactured using a green sheet technique. It was sintered for two hours at 1100 degrees Celsius in the air, and the piezoelectric material layer was polarized thereafter. An epoxy adhesive was used for joining the piezoelectric element 6 to the base 7, the base 7 to the diaphragm 8, and the support member 9 to the diaphragm 8. Further, an epoxy adhesive was also used for joining the piezoelectric actuator 2 to the support body 3.

The following tests 1 to 3 were performed on the manufactured piezoelectric acoustic device 1.

Test 1

In order to evaluate the characteristics of the piezoelectric actuators, the fundamental resonant frequency when an AC voltage of 1V was supplied to each piezoelectric actuator was measured.

Test 2

In order to evaluate the characteristics of the piezoelectric acoustic device, the sound pressure levels when the AC voltage of 1V was supplied were respectively measured at measured frequencies of 1 kHz, 3 kHz, 5 kHz, and 10 kHz with a microphone disposed at a position 10 cm away from the device (explaining using FIG. 1, at a position 10 cm away from the center of the support board 3*a*). Note that the plurality of piezoelectric actuators in the piezoelectric acoustic device were driven so that the phases were same and that the vibration direction relative to each sound radiation surface was identical to each other (so that the piezoelectric acoustic device simultaneously expands or contracts).

Test 3

In order to evaluate the stability against the shock from a fall, a mobile telephone having the piezoelectric acoustic device built therein was naturally dropped five times from 50 cm directly above. Damages such as cracks were visually observed and the sound pressure characteristics before and after the test were compared. In Table 1, ○ indicates a sound pressure level difference (difference between sound pressure levels before and after the test) at 1 kHz equal to or less than 3 dB, and x indicates a difference of at least [greater than] 3 dB.

Figure 24:
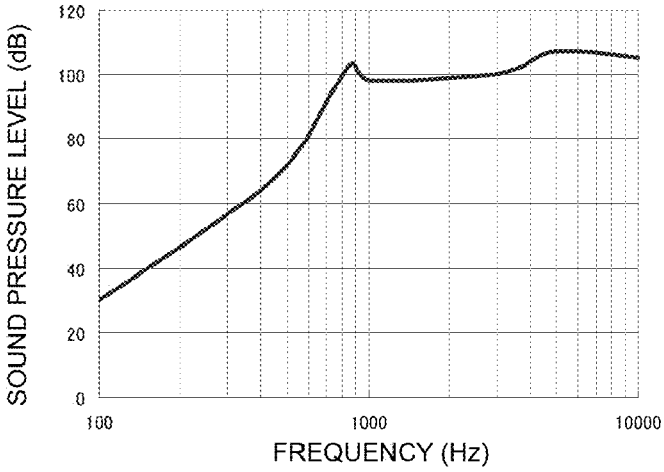
FIG. 24 is a frequency characteristics graph of a piezoelectric acoustic device according to Example 1.

FIG. 24 shows an acoustic characteristic graph of the present example showing how the sound pressure changes due to frequency changes. As a result, the piezoelectric acoustic device of the present example had a fundamental resonant frequency equal to or lower than 1 kHz and sound pressure levels exceeding 90 dB in a wide frequency band from 1 to 10 kHz. The piezoelectric acoustic device of the present example demonstrated to have favorable acoustic characteristics without any acoustic valley. Further, it also demonstrated to have high stability against the shock from a fall.

Example 2

Figure 25:
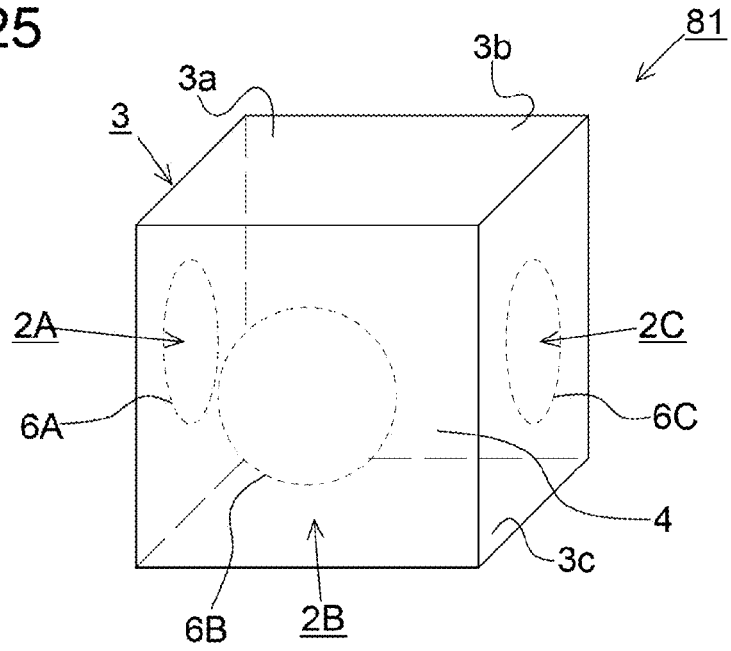
FIG. 25 is a schematic perspective view of a piezoelectric acoustic device according to Example 2.

As a piezoelectric acoustic device according to Example 2, the piezoelectric acoustic device 71 comprising three piezoelectric actuators 2A to 2C, as shown in FIG. 25, was manufactured. The piezoelectric actuators 2A to 2C were configured identically to Example 1. The piezoelectric acoustic device 71 was configured identically to Example 1, except for the number of the piezoelectric actuators and for the fact that the support boards were formed on three surfaces of the support body.

Figure 26:
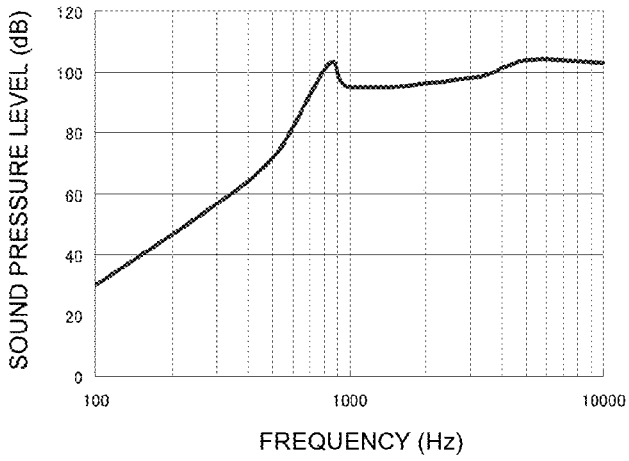
FIG. 26 is a frequency characteristics graph of a piezoelectric acoustic device according to Example 2.

The tests 1 to 3 were performed as in Example 1. FIG. 26 shows an acoustic characteristic graph of the present example showing how the sound pressure changes due to frequency changes. As a result, the piezoelectric acoustic device 71 of the present example demonstrated to have a fundamental resonant frequency equal to or lower than 1 kHz and sound pressure levels exceeding 90 dB in the wide frequency band from 1 to 10 kHz. Further, it also demonstrated to have high stability against the shock from a fall.

Example 3

As a piezoelectric acoustic device according to Example 3, the piezoelectric acoustic device 21 according to the second mode and comprising two piezoelectric actuators 2A and 2B, as shown in FIGS. 8 and 9, was manufactured. The piezoelectric actuators were configured similarly to Example 1. The piezoelectric acoustic device was configured similarly to Example 1, except for the number of the piezoelectric actuators and for the fact that the support boards were formed on two surfaces of the support body.

Figure 27:
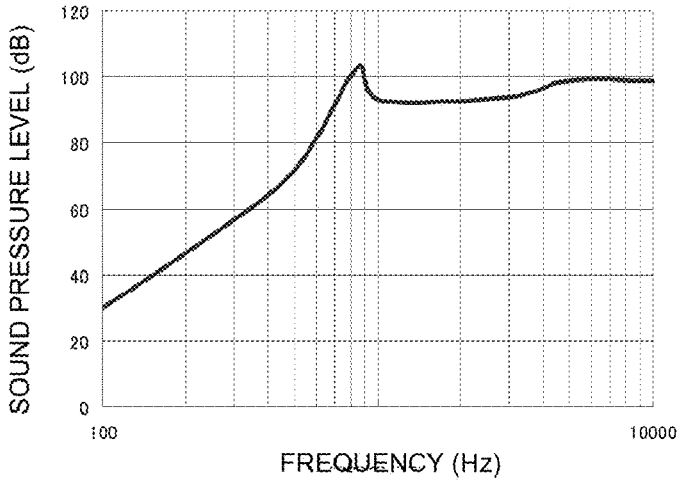
FIG. 27 is a frequency characteristics graph of a piezoelectric acoustic device according to Example 3.

The tests 1 to 3 were performed as in Example 1. FIG. 27 shows an acoustic characteristic graph of the present example showing how the sound pressure changes due to frequency changes. As a result, the piezoelectric acoustic device of the present example demonstrated to have a fundamental resonant frequency equal to or lower than 1 kHz and sound pressure levels exceeding 90 dB in the wide frequency band from 1 to 10 kHz. Further, it also demonstrated to have high stability against the shock from a fall.

Example 4

Figure 28:
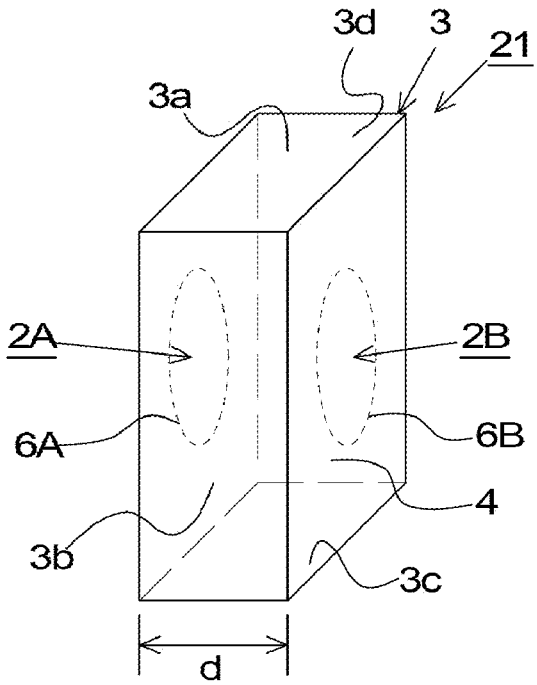
FIG. 28 is a schematic perspective view for explaining piezoelectric acoustic devices according to Examples 4 and 5.

As a piezoelectric acoustic device according to Example 4, a piezoelectric acoustic device comprising two piezoelectric actuators was manufactured as in Example 3. The piezoelectric acoustic device according to Example 4 differed from the piezoelectric acoustic device according to Example 3 in that the gap between the piezoelectric actuators was narrower. The support body in the present example had a length, width, and depth of 21 mm by 21 mm by 5 mm, and the support body between the piezoelectric actuators had a depth d of 5 mm (21 mm in Example 3), as shown in FIG. 28.

Figure 29:
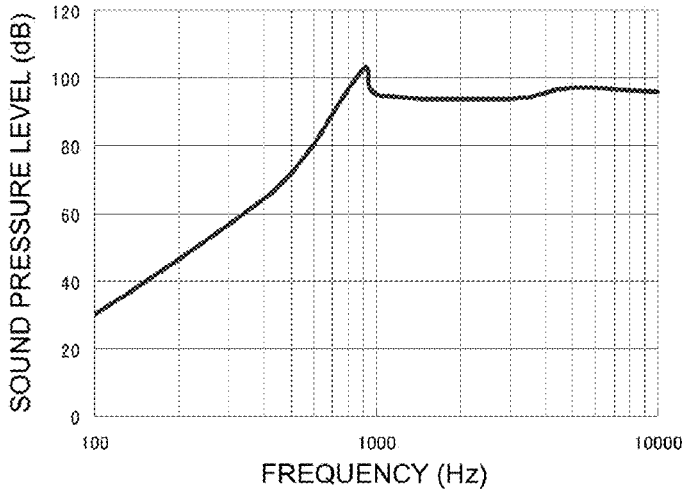
FIG. 29 is a frequency characteristics graph of a piezoelectric acoustic device according to Example 4.

The tests 1 to 3 were performed as in Example 1. FIG. 29 shows an acoustic characteristic graph of the present example showing how the sound pressure changes due to frequency changes. As a result, the piezoelectric acoustic device of the present example demonstrated to have a fundamental resonant frequency equal to or lower than 1 kHz and sound pressure levels exceeding 90 dB in the wide frequency band from 1 to 10 kHz. Further, it also demonstrated to have high stability against the shock from a fall.

Example 5

As a piezoelectric acoustic device according to Example 5, a piezoelectric acoustic device comprising two piezoelectric actuators was manufactured as in Example 3. The piezoelectric acoustic device according to Example 5 differed from the piezoelectric acoustic device according to Example 3 in that the gap between the piezoelectric actuators was narrower. The support body in the present example had a length, width, and depth of 21 mm by 21 mm by 1.5 mm, and the support body between the piezoelectric actuators had a depth d of 1.5 mm, as shown in FIG. 28.

Figure 30:
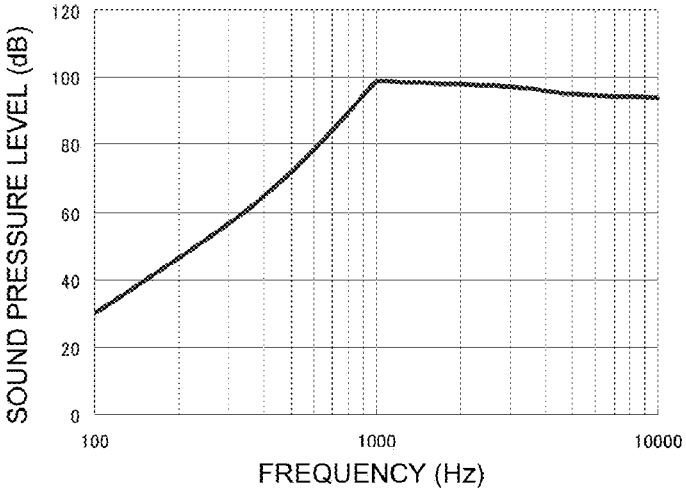
FIG. 30 is a frequency characteristics graph of a piezoelectric acoustic device according to Example 5.

The tests 1 to 3 were performed as in Example 1. FIG. 30 shows an acoustic characteristic graph of the present example showing how the sound pressure changes due to frequency changes. As a result, the piezoelectric acoustic device of the present example demonstrated to have a fundamental resonant frequency equal to or lower than 1 kHz and sound pressure levels exceeding 90 dB in the wide frequency band from 1 to 10 kHz. Further, it also demonstrated to have high stability against the shock from a fall. Moreover, the piezoelectric acoustic device of the present example was a small-size acoustic device having a thickness not greater than 2 mm, and also demonstrated to be useful for being mounted into a mobile apparatus.

Example 6

As a piezoelectric acoustic device according to Example 6, the piezoelectric acoustic device according to the third mode and comprising two piezoelectric actuators was manufactured. The configuration of the piezoelectric acoustic device in the present example was identical to that of the piezoelectric acoustic device according to Example 3, except for the fact that a sound hole was formed on one of the support boards. The sound hole had a size of 3 mm by 3 mm and was formed in the center of one of the support boards.

Figure 31:
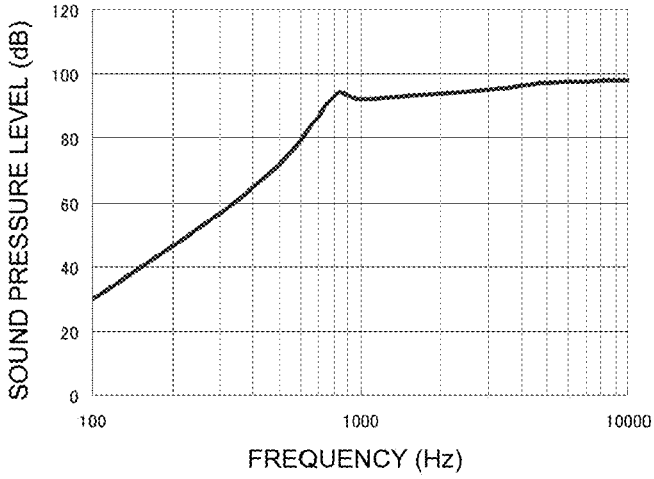
FIG. 31 is a frequency characteristics graph of a piezoelectric acoustic device according to Example 6.

The tests 1 to 3 were performed as in Example 1. FIG. 31 shows an acoustic characteristic graph of the present example showing how the sound pressure changes due to frequency changes. As a result, the piezoelectric acoustic device of the present example demonstrated to have a fundamental resonant frequency equal to or lower than 1 kHz and sound pressure levels exceeding 90 dB in the wide frequency band from 1 to 10 kHz. Further, it also demonstrated to have high stability against the shock from a fall.

Example 7

Figure 32:
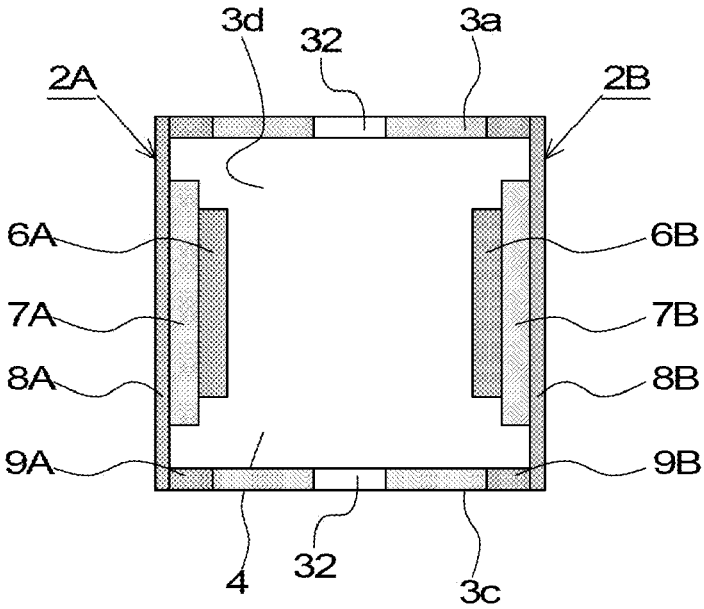
FIG. 32 is a schematic perspective view of a piezoelectric acoustic device according to Example 7.

As a piezoelectric acoustic device according to Example 7, a piezoelectric acoustic device comprising two piezoelectric actuators was manufactured as in Example 6. The piezoelectric acoustic device according to Example 7 differed from the piezoelectric acoustic device according to Example 6 in that the sound holes 32 were formed on two support boards, as shown in FIG. 32. The sound holes 32 were formed on two facing support boards.

Figure 33:
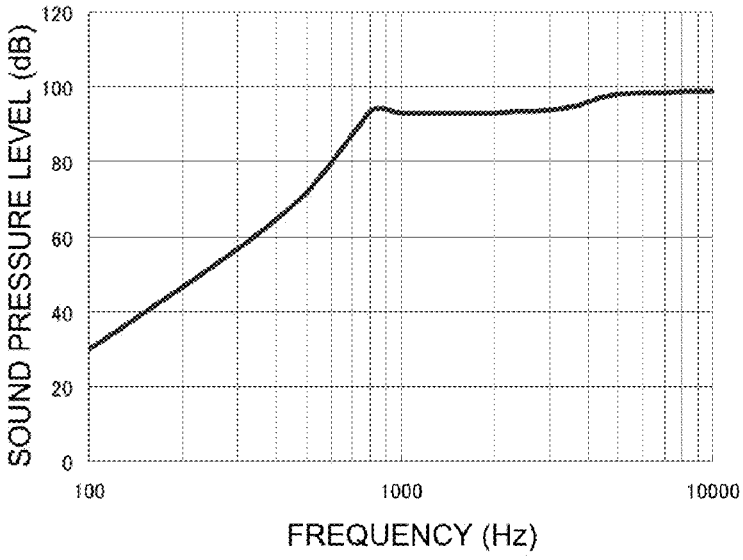
FIG. 33 is a frequency characteristics graph of a piezoelectric acoustic device according to Example 7.

The tests 1 to 3 were performed as in Example 1. FIG. 33 shows an acoustic characteristic graph of the present example showing how the sound pressure changes due to frequency changes. As a result, the piezoelectric acoustic device of the present example demonstrated to have a fundamental resonant frequency equal to or lower than 1 kHz and sound pressure levels exceeding 90 dB in the wide frequency band from 1 to 10 kHz. Further, it also demonstrated to have high stability against the shock from a fall.

Example 8

As a piezoelectric acoustic device according to Example 8, the piezoelectric acoustic device according to the fifth mode and comprising two piezoelectric actuators was manufactured. The configuration of the piezoelectric acoustic device in the present example was identical to that of the piezoelectric acoustic device according to Example 3, except for the fact that the fundamental resonant frequencies of the two piezoelectric actuators were different. In other words, in the piezoelectric acoustic device according to Example 8, by setting the diaphragm thickness of one of the piezoelectric actuators to 50 μm and the diaphragm thickness of the other piezoelectric actuator to 80 μm, thereby varying the diaphragm thicknesses, the fundamental resonant frequencies of the two piezoelectric actuators were varied. Except for this, the piezoelectric acoustic device according to the present example was identical to the piezoelectric acoustic device according to Example 3.

Figure 34:
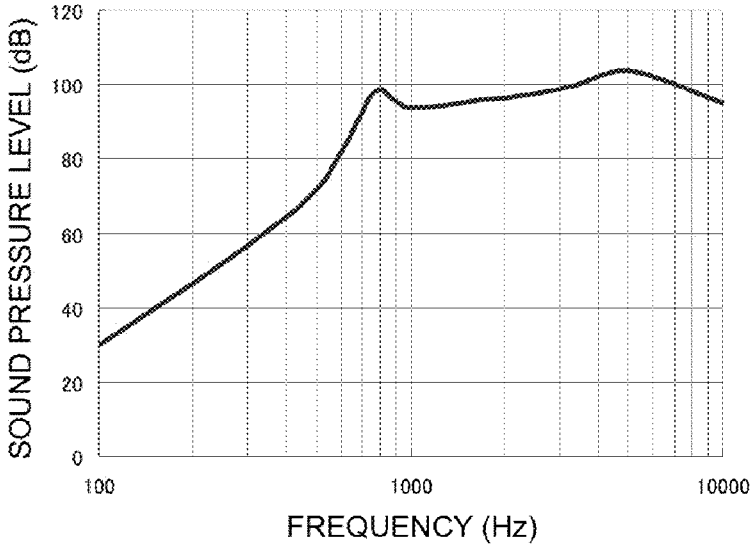
FIG. 34 is a frequency characteristics graph of a piezoelectric acoustic device according to Example 8.

The tests 1 to 3 were performed as in Example 1. FIG. 34 shows an acoustic characteristic graph of the present example showing how the sound pressure changes due to frequency changes. As a result, the piezoelectric acoustic device of the present example demonstrated to have sound pressure levels exceeding 90 dB in the wide frequency band from 1 to 10 kHz. Further, it also demonstrated to have high stability against the shock from a fall.

Example 9

As a piezoelectric acoustic device according to Example 9, a piezoelectric acoustic device comprising two piezoelectric actuators was manufactured as in Example 8. The piezoelectric acoustic device according to Example 9 differed from the piezoelectric acoustic device according to Example 8 in that the thickness of one of the diaphragms was made even thinner. In the present example, the thickness of one of the diaphragms was 30 μm, and the thickness of the other diaphragm was 80 μm.

Figure 35:
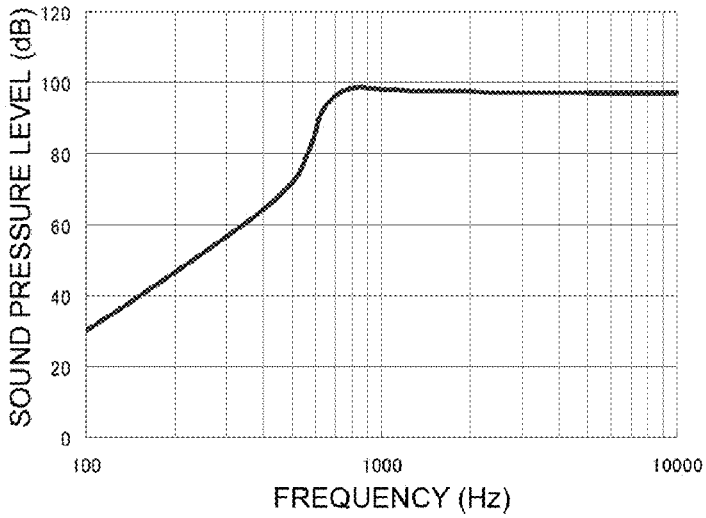
FIG. 35 is a frequency characteristics graph of a piezoelectric acoustic device according to Example 9.

The tests 1 to 3 were performed as in Example 1. FIG. 35 shows an acoustic characteristic graph of the present example showing how the sound pressure changes due to frequency changes. As a result, the piezoelectric acoustic device of the present example demonstrated to have sound pressure levels exceeding 90 dB in the wide frequency band from 1 to 10 kHz. Further, it also demonstrated to have high stability against the shock from a fall.

Example 10

As a piezoelectric acoustic device according to Example 10, a piezoelectric acoustic device comprising two piezoelectric actuators was manufactured as in Example 3. The piezoelectric acoustic device according to Example 10 differed from the piezoelectric acoustic device according to Example 3 in the sizes of the piezoelectric actuators and the support body. In the present example, the outer diameter of the piezoelectric element was ϕ12 mm; the outer diameter of the base was ϕ13 mm; the size of the diaphragm (length by width) was 15 mm by 15 mm; the outer size of the support member (length by width) was 15 mm by 15 mm; the inner size of the support member (length by width) was 14 mm by 14 mm; and the size of the support body was 15 mm by 15 mm by 15 mm.

Figure 36:
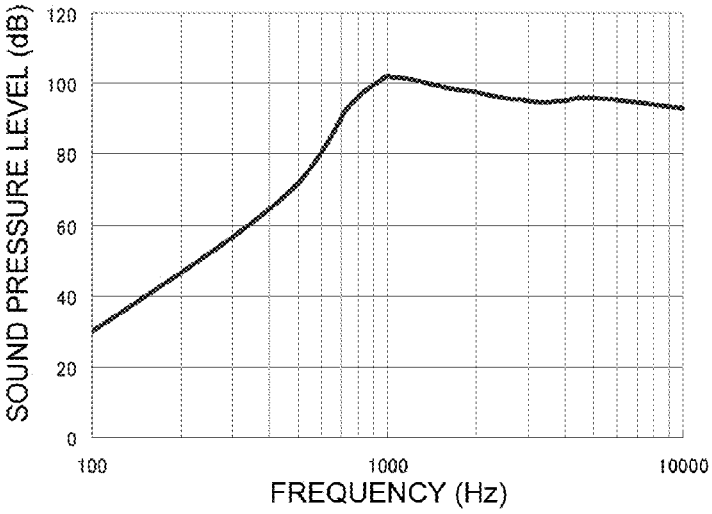
FIG. 36 is a frequency characteristics graph of a piezoelectric acoustic device according to Example 10.

The tests 1 to 3 were performed as in Example 1. FIG. 36 shows an acoustic characteristic graph of the present example showing how the sound pressure changes due to frequency changes. As a result, the piezoelectric acoustic device of the present example demonstrated to have a fundamental resonant frequency equal to or lower than 1 kHz and sound pressure levels exceeding 90 dB in the wide frequency band from 1 to 10 kHz. Further, it also demonstrated to have high stability against the shock from a fall.

Example 11

As a piezoelectric acoustic device according to Example 11, a piezoelectric acoustic device comprising two piezoelectric actuators was manufactured as in Example 3. The piezoelectric acoustic device according to Example 11 differed from the piezoelectric acoustic device according to Example 3 in the material of the diaphragm. In Example 3, urethane was used for the diaphragm, whereas polyethylene was used in the present example.

Figure 37:
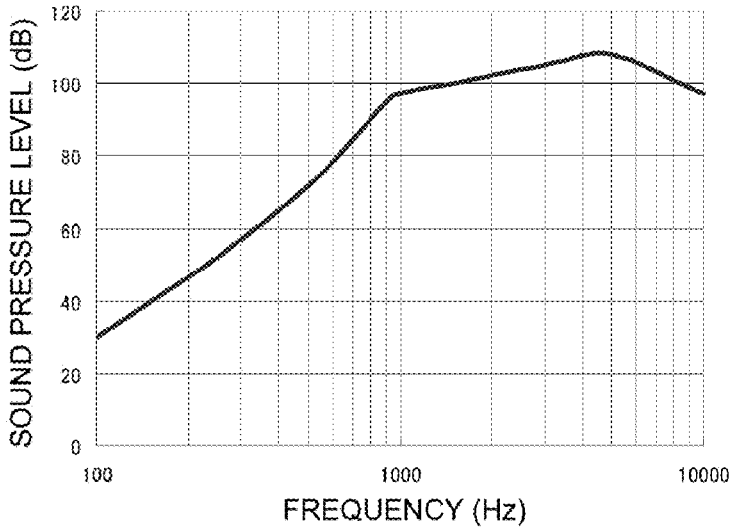
FIG. 37 is a frequency characteristics graph of a piezoelectric acoustic device according to Example 11.

The tests 1 to 3 were performed as in Example 1. FIG. 37 shows an acoustic characteristic graph of the present example showing how the sound pressure changes due to frequency changes. As a result, the piezoelectric acoustic device of the present example demonstrated to have a fundamental resonant frequency equal to or lower than 1 kHz and sound pressure levels exceeding 90 dB in the wide frequency band from 1 to 10 kHz. Further, it also demonstrated to have high stability against the shock from a fall.

Example 12

As a piezoelectric acoustic device according to Example 12, the piezoelectric acoustic device according to the sixth mode and comprising two bimorph piezoelectric actuators was manufactured. The piezoelectric elements, in which the upper electrode layer and the lower electrode layer each having a thickness of 8 μm were formed on both surfaces of the piezoelectric plates having an outer diameter of ϕ16 mm and a thickness of 50 μm (0.05 mm), were concentrically joined to both surfaces of a phosphor bronze base having an outer diameter of ϕ18 mm and a thickness of 30 μm (0.03 mm). The diaphragm was a polyethylene film having an outer diameter of 21 mm by 21 mm and a thickness of 80 μm, and had an opening having a diameter of 17 mm in order to let one of the piezoelectric plates penetrate.

Figure 38:
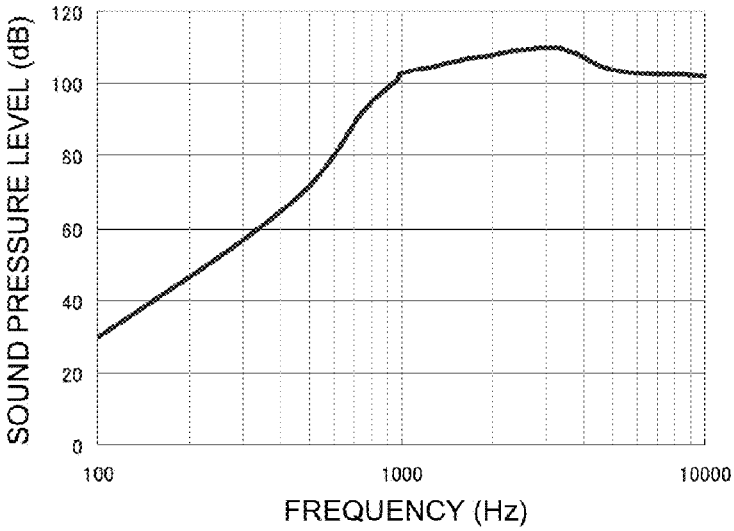
FIG. 38 is a frequency characteristics graph of a piezoelectric acoustic device according to Example 12.

The tests 1 to 3 were performed as in Example 1. FIG. 38 shows an acoustic characteristic graph of the present example showing how the sound pressure changes due to frequency changes. As a result, the piezoelectric acoustic device of the present example demonstrated to have a fundamental resonant frequency equal to or lower than 1 kHz and sound pressure levels exceeding 90 dB in the wide frequency band from 1 to 10 kHz. Further, it also demonstrated to have high stability against the shock from a fall.

Example 13

As a piezoelectric acoustic device according to Example 13, a piezoelectric acoustic device comprising two piezoelectric actuators was manufactured as in Example 6. The piezoelectric acoustic device according to Example 13 differed from the piezoelectric acoustic device according to Example 6 in the opening size of the sound hole. The sound hole was a hole of 3 mm by 3 mm in Example 6, whereas the opening was a square of 2 mm by 2 mm in the present example.

The tests 1 to 3 were performed as in Example 1. As a result, the piezoelectric acoustic device of the present example demonstrated to have a fundamental resonant frequency equal to or lower than 1 kHz and sound pressure levels exceeding 90 dB in the wide frequency band from 1 to 10 kHz. The piezoelectric acoustic device of the present example further demonstrated to have favorable acoustic characteristics without any acoustic valley. Moreover, it also demonstrated to have high stability against the shock from a fall.

Example 14

As a piezoelectric acoustic device according to Example 14, the piezoelectric acoustic device 71 according to the seventh mode and comprising three piezoelectric actuators 2A to 2C, as shown in FIGS. 17 and 18, was manufactured. The configuration of the piezoelectric actuators 2A to 2C was identical to Example 1. The configuration of the piezoelectric acoustic device 71 was identical to Example 13, except for the number of the piezoelectric actuators.

Figure 39:
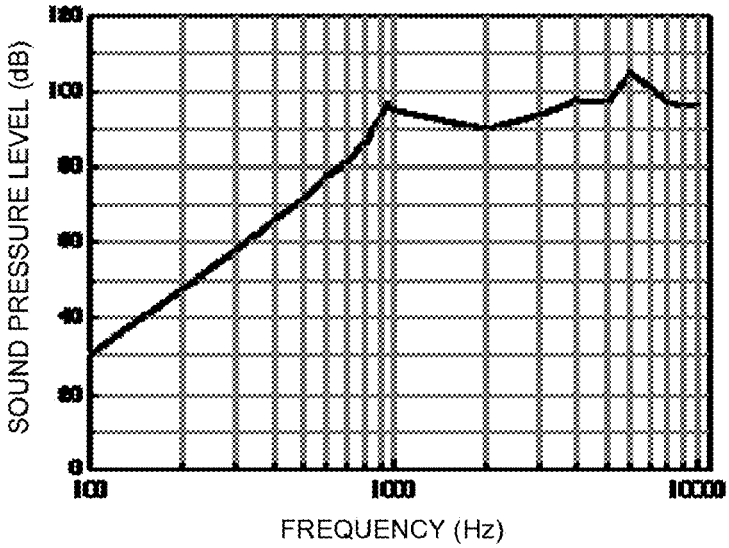
FIG. 39 is a frequency characteristics graph of a piezoelectric acoustic device according to Example 14.

The tests 1 to 3 were performed as in Example 1. FIG. 39 shows an acoustic characteristic graph of the present example showing how the sound pressure changes due to frequency changes. As a result, the piezoelectric acoustic device 71 of the present example demonstrated to have a fundamental resonant frequency equal to or lower than 1 kHz and sound pressure levels exceeding 90 dB in the wide frequency band from 1 to 10 kHz. Further, it also demonstrated to have high stability against the shock from a fall.

Example 15

As a piezoelectric acoustic device according to Example 15, a piezoelectric acoustic device comprising two piezoelectric actuators was manufactured as in Example 13. The piezoelectric acoustic device according to Example 15 differed from the piezoelectric acoustic device according to Example 13 in that the gap between the piezoelectric actuators was narrower. The support body in the present example had a length, width, and depth of 21 mm by 21 mm by 5 mm, and the support body between the piezoelectric actuators had a depth d of 5 mm (21 mm in Example 13), as shown in FIG. 28 (which differed from the present example in that there was no sound hole).

Figure 40:
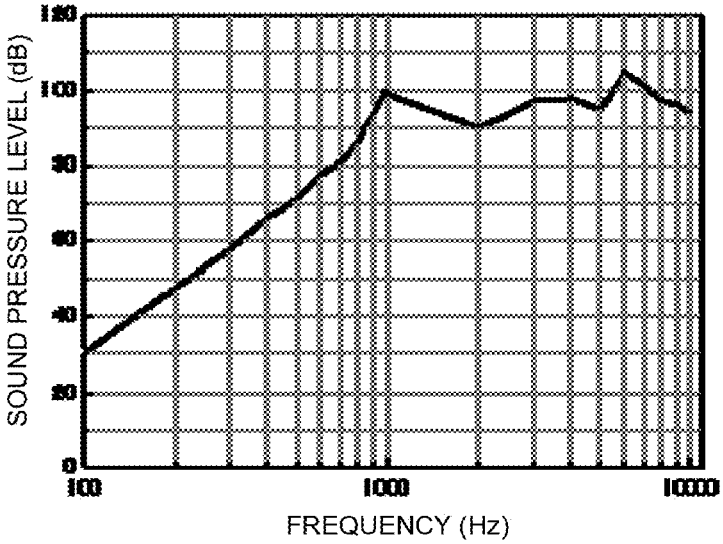
FIG. 40 is a frequency characteristics graph of a piezoelectric acoustic device according to Example 15.

The tests 1 to 3 were performed as in Example 1. FIG. 40 shows an acoustic characteristic graph of the present example showing how the sound pressure changes due to frequency changes. As a result, the piezoelectric acoustic device of the present example demonstrated to have a fundamental resonant frequency equal to or lower than 1 kHz and sound pressure levels exceeding 90 dB in the wide frequency band from 1 to 10 kHz. Further, it also demonstrated to have high stability against the shock from a fall.

Example 16

As a piezoelectric acoustic device according to Example 16, a piezoelectric acoustic device comprising two piezoelectric actuators was manufactured as in Example 13. The piezoelectric acoustic device according to Example 16 differed from the piezoelectric acoustic device according to Example 13 in that the gap between the piezoelectric actuators was narrower. The support body in the present example had a length, width, and depth of 21 mm by 21 mm by 1.5 mm, and the support body between the piezoelectric actuators had a depth d of 1.5 mm, as shown in FIG. 28.

Figure 41:
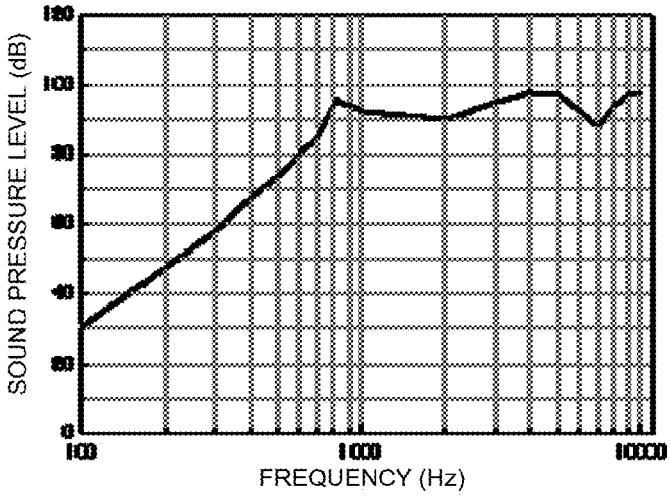
FIG. 41 is a frequency characteristics graph of a piezoelectric acoustic device according to Example 16.

The tests 1 to 3 were performed as in Example 1. FIG. 41 shows an acoustic characteristic graph of the present example showing how the sound pressure changes due to frequency changes. As a result, the piezoelectric acoustic device of the present example demonstrated to have a fundamental resonant frequency equal to or lower than 1 kHz and sound pressure levels exceeding 90 dB over most of the frequency band from 1 to 10 kHz. Further, it also demonstrated to have high stability against the shock from a fall. Moreover, the piezoelectric acoustic device of the present example was a small-size acoustic device having a thickness not greater than 2 mm, and also demonstrated to be useful for being mounted into a mobile apparatus.

Example 17

As a piezoelectric acoustic device according to Example 17, a piezoelectric acoustic device comprising two piezoelectric actuators was manufactured as in Example 13. The piezoelectric acoustic device according to Example 17 differed from the piezoelectric acoustic device according to Example 13 in that there were two support boards on which the sound hole 32 was formed, as shown in FIG. 31. The sound holes 32 were formed on facing support boards.

Figure 42:
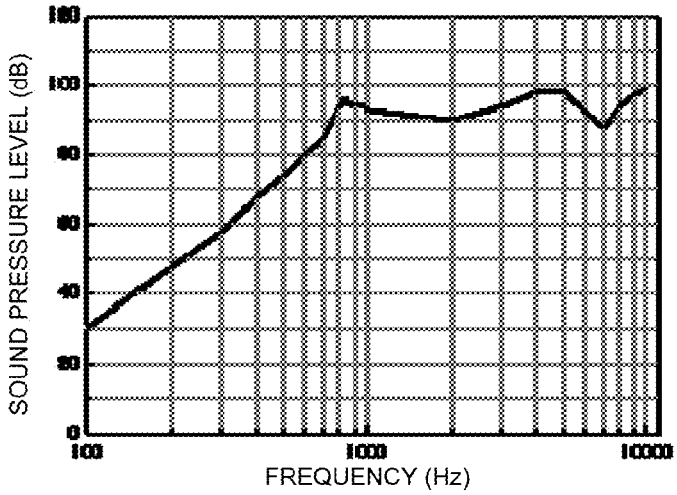
FIG. 42 is a frequency characteristics graph of a piezoelectric acoustic device according to Example 17.

The tests 1 to 3 were performed as in Example 1. FIG. 42 shows an acoustic characteristic graph of the present example showing how the sound pressure changes due to frequency changes. As a result, the piezoelectric acoustic device of the present example demonstrated to have a fundamental resonant frequency equal to or lower than 1 kHz and sound pressure levels exceeding 90 dB over most of the frequency band from 1 to 10 kHz. Further, it also demonstrated to have high stability against the shock from a fall.

Example 18

As a piezoelectric acoustic device according to Example 18, the piezoelectric acoustic device according to the fifth mode and comprising two piezoelectric actuators was manufactured. The piezoelectric acoustic device according to the present example comprises two piezoelectric actuators as in Example 13, however, it differed from Example 13 in that the fundamental resonant frequencies of the two piezoelectric actuators were different. In other words, in the piezoelectric acoustic device according to Example 18, by setting the diaphragm thickness of one of the piezoelectric actuators to 50 μm and the diaphragm thickness of the other piezoelectric actuator to 80 μm, thereby varying the diaphragm thicknesses, the fundamental resonant frequencies of the two piezoelectric actuators were varied. Except for this, the piezoelectric acoustic device according to the present example was identical to the piezoelectric acoustic device according to Example 13.

Figure 43:
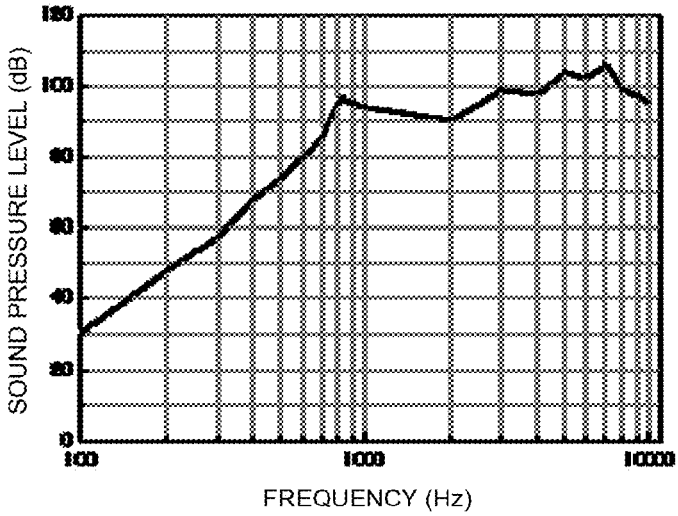
FIG. 43 is a frequency characteristics graph of a piezoelectric acoustic device according to Example 18.

The tests 1 to 3 were performed as in Example 1. FIG. 43 shows an acoustic characteristic graph of the present example showing how the sound pressure changes due to frequency changes. As a result, the piezoelectric acoustic device of the present example demonstrated to have sound pressure levels exceeding 90 dB in the wide frequency band from 1 to 10 kHz. Further, it also demonstrated to have high stability against the shock from a fall.

Example 19

As a piezoelectric acoustic device according to Example 19, a piezoelectric acoustic device comprising two piezoelectric actuators was manufactured as in Example 18. The piezoelectric acoustic device according to Example 19 differed from the piezoelectric acoustic device according to Example 18 in that the thickness of one of the diaphragms was made even thinner. In the present example, the thickness of one of the diaphragms was 30 μm, and the thickness of the other diaphragm was 80 μm.

The tests 1 to 3 were performed as in Example 1. As a result, the piezoelectric acoustic device of the present example demonstrated to have sound pressure levels exceeding 90 dB in the wide frequency band from 1 to 10 kHz. Further, it also demonstrated to have high stability against the shock from a fall.

Example 20

As a piezoelectric acoustic device according to Example 20, a piezoelectric acoustic device comprising two piezoelectric actuators was manufactured as in Example 13. The piezoelectric acoustic device according to Example 20 differed from the piezoelectric acoustic device according to Example 13 in the sizes of the piezoelectric actuators and the support body. In the present example, the outer diameter of the piezoelectric element was ϕ12 mm; the outer diameter of the base was ϕ13 mm; the size of the diaphragm (length by width) was 15 mm by 15 mm; the outer size of the support member (length by width) was 15 mm by 15 mm; the inner size of the support member (length by width) was 14 mm by 14 mm; and the size of the support body was 15 mm by 15 mm by 15 mm.

Figure 44:
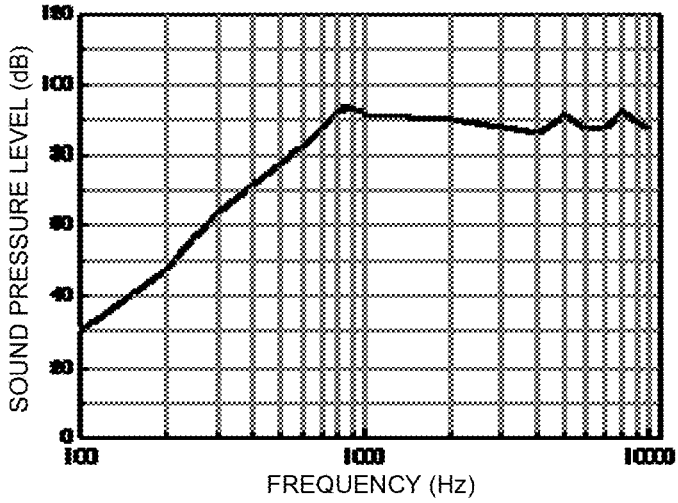
FIG. 44 is a frequency characteristics graph of a piezoelectric acoustic device according to Example 20.

The tests 1 to 3 were performed as in Example 1. FIG. 44 shows an acoustic characteristic graph of the present example showing how the sound pressure changes due to frequency changes. As a result, even if the piezoelectric actuators are downsized, the piezoelectric acoustic device of the present example demonstrated to have a fundamental resonant frequency equal to or lower than 1 kHz and sound pressure levels exceeding 85 dB in the wide frequency band from 1 to 10 kHz. Further, it also demonstrated to have high stability against the shock from a fall.

Example 21

As a piezoelectric acoustic device according to Example 21, a piezoelectric acoustic device comprising two piezoelectric actuators was manufactured as in Example 13. The piezoelectric acoustic device according to Example 21 differed from the piezoelectric acoustic device according to Example 13 in the sizes of the piezoelectric actuators and the support body. In the present example, the outer diameter of the piezoelectric element was ϕ10 mm; the outer diameter of the base was ϕ11 mm; the size of the diaphragm (length by width) was 15 mm by 15 mm; the outer size of the support member (length by width) was 15 mm by 15 mm; the inner size of the support member (length by width) was 14 mm by 14 mm; and the size of the support body was 15 mm by 15 mm by 15 mm.

The tests 1 to 3 were performed as in Example 1. As a result, even if the piezoelectric actuators are downsized, the piezoelectric acoustic device of the present example demonstrated to have a fundamental resonant frequency equal to or lower than 1 kHz and sound pressure levels exceeding 90 dB at 5 kHz and 10 kHz. Further, it also demonstrated to have high stability against the shock from a fall.

Example 22

As a piezoelectric acoustic device according to Example 22, a piezoelectric acoustic device comprising two piezoelectric actuators was manufactured as in Example 13. The piezoelectric acoustic device according to Example 22 differed from the piezoelectric acoustic device according to Example 13 in the sizes of the piezoelectric actuators and the support body. In the present example, the outer diameter of the piezoelectric element was ϕ8 mm; the outer diameter of the base was ϕ9 mm; the size of the diaphragm (length by width) was 15 mm by 15 mm; the outer size of the support member (length by width) was 15 mm by 15 mm; the inner size of the support member (length by width) was 14 mm by 14 mm; and the size of the support body was 15 mm by 15 mm by 15 mm.

The tests 1 to 3 were performed as in Example 1. As a result, even if the piezoelectric actuators are downsized, the piezoelectric acoustic device of the present example demonstrated to have a fundamental resonant frequency equal to or lower than 1 kHz and a sound pressure level exceeding 90 dB at 5 kHz. Further, it also demonstrated to have high stability against the shock from a fall.

Example 23

As a piezoelectric acoustic device according to Example 23, a piezoelectric acoustic device comprising two piezoelectric actuators was manufactured as in Example 13. The piezoelectric acoustic device according to Example 23 differed from the piezoelectric acoustic device according to Example 13 in the material of the diaphragm. In Example 13, urethane was used for the diaphragm, whereas polyethylene was used in the present example.

Figure 45:
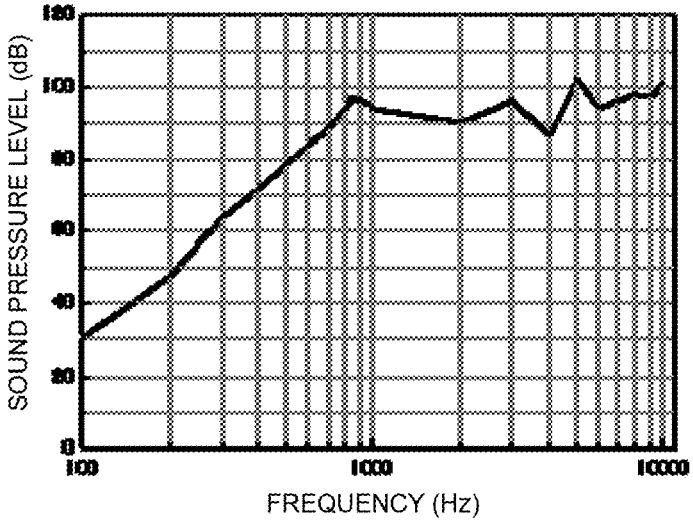
FIG. 45 is a frequency characteristics graph of a piezoelectric acoustic device according to Example 23.

The tests 1 to 3 were performed as in Example 1. FIG. 45 shows an acoustic characteristic graph of the present example showing how the sound pressure changes due to frequency changes. As a result, the piezoelectric acoustic device of the present example demonstrated to have a fundamental resonant frequency equal to or lower than 1 kHz and sound pressure levels exceeding 90 dB in the wide frequency band from 1 to 10 kHz. Further, it also demonstrated to have high stability against the shock from a fall.

Example 24

As a piezoelectric acoustic device according to Example 24, a piezoelectric acoustic device comprising two piezoelectric actuators was manufactured as in Example 13. The piezoelectric acoustic device according to Example 24 differed from the piezoelectric acoustic device according to Example 13 in the material of the diaphragm. In Example 13, urethane was used for the diaphragm, whereas polyethylene terephthalate was used in the present example.

The tests 1 to 3 were performed as in Example 1. As a result, the piezoelectric acoustic device of the present example demonstrated to have a fundamental resonant frequency equal to or lower than 1 kHz and sound pressure levels exceeding 90 dB over most of the frequency band from 1 to 10 kHz. Further, it also demonstrated to have high stability against the shock from a fall.

Example 25

As a piezoelectric acoustic device according to Example 25, the piezoelectric acoustic device according to the sixth mode and comprising two bimorph piezoelectric actuators was manufactured. The piezoelectric elements, in which the upper electrode layer and the lower electrode layer each having a thickness of 8 μm were formed on both surfaces of the piezoelectric plates having an outer diameter of ϕ16 mm and a thickness of 50 μm (0.05 mm), were concentrically joined to both surfaces of a phosphor bronze base having an outer diameter of ϕ18 mm and a thickness of 30 μm (0.03 mm). The diaphragm was a urethane film having an outer diameter of 21 mm by 21 mm and a thickness of 80 μm, and had an opening having a diameter of 17 mm in order to let one of the piezoelectric plates penetrate. Further, as in Example 13, a sound hole of 2 mm by 2 mm was formed on the support board.

The tests 1 to 3 were performed as in Example 1. As a result, the piezoelectric acoustic device of the present example demonstrated to have a fundamental resonant frequency equal to or lower than 1 kHz and sound pressure levels exceeding 90 dB in the wide frequency band from 1 to 10 kHz. Further, it also demonstrated to have high stability against the shock from a fall.

Example 26

As a piezoelectric acoustic device according to Example 26, a piezoelectric acoustic device comprising two piezoelectric actuators was manufactured as in Example 13. The piezoelectric acoustic device according to Example 26 differed from the piezoelectric acoustic device according to Example 13 in the number of the sound holes on the support board 3*a*. In Example 13, there was only one sound hole, whereas there were two sound holes in the present example. Note that the sizes of the sound holes were 2 mm by 2 mm as in Example 13.

Figure 46:
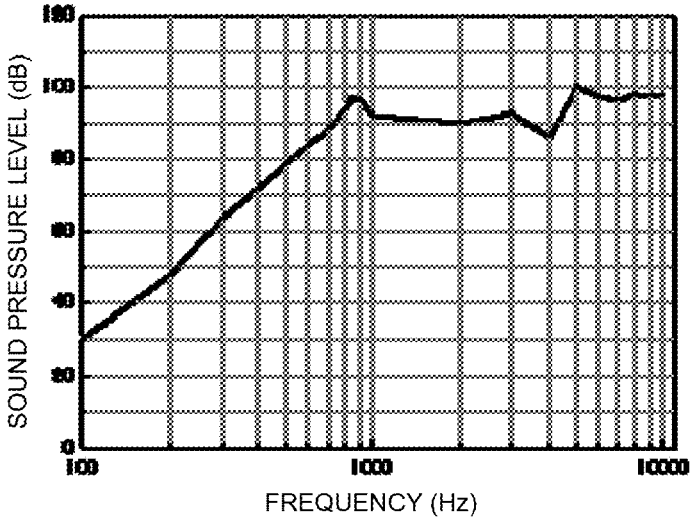
FIG. 46 is a frequency characteristics graph of a piezoelectric acoustic device according to Example 26.

The tests 1 to 3 were performed as in Example 1. FIG. 46 shows an acoustic characteristic graph of the present example showing how the sound pressure changes due to frequency changes. As a result, the piezoelectric acoustic device of the present example demonstrated to have a fundamental resonant frequency equal to or lower than 1 kHz and sound pressure levels exceeding 90 dB in the wide frequency band from 1 to 10 kHz. Further, it also demonstrated to have high stability against the shock from a fall.

Example 27

As a piezoelectric acoustic device according to Example 27, a piezoelectric acoustic device comprising two piezoelectric actuators was manufactured as in Example 13. The piezoelectric acoustic device according to Example 27 differed from the piezoelectric acoustic device according to Example 13 in the number of the sound holes on the support board 3*a*. In Example 13, there was only one sound hole, whereas there were three sound holes in the present example. Note that the sizes of the sound holes were 2 mm by 2 mm as in Example 13.

The tests 1 to 3 were performed as in Example 1. As a result, the piezoelectric acoustic device of the present example demonstrated to have a fundamental resonant frequency equal to or lower than 1 kHz and sound pressure levels exceeding 90 dB in the wide frequency band from 1 to 10 kHz. Further, it also demonstrated to have high stability against the shock from a fall.

Example 28

As a piezoelectric acoustic device according to Example 28, a piezoelectric acoustic device comprising two piezoelectric actuators was manufactured as in Example 13. The piezoelectric acoustic device according to Example 28 differed from the piezoelectric acoustic device according to Example 13 in the number of the sound holes on the support board 3*a*. In Example 13, there was only one sound hole, whereas there were four sound holes in the present example. Note that the sizes of the sound holes were 2 mm by 2 mm as in Example 13.

Figure 47:
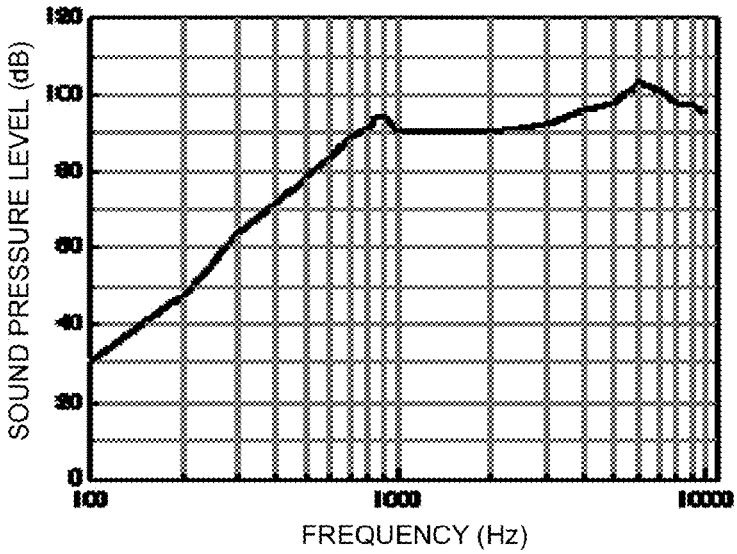
FIG. 47 is a frequency characteristics graph of a piezoelectric acoustic device according to Example 28.

The tests 1 to 3 were performed as in Example 1. FIG. 47 shows an acoustic characteristic graph of the present example showing how the sound pressure changes due to frequency changes. As a result, the piezoelectric acoustic device of the present example demonstrated to have a fundamental resonant frequency equal to or lower than 1 kHz and sound pressure levels exceeding 90 dB in the wide frequency band from 1 to 10 kHz. Further, it also demonstrated to have high stability against the shock from a fall.

Example 29

As a piezoelectric acoustic device according to Example 29, a piezoelectric acoustic device comprising two piezoelectric actuators was manufactured as in Example 13. The piezoelectric acoustic device according to Example 29 differed from the piezoelectric acoustic device according to Example 13 in the opening size of the sound hole on the support board 3*a*. The sound hole had an opening size of 2 mm by 2 mm in Example 13, whereas, in the present example, it had a length and width of 1 mm by 1 mm.

The tests 1 to 3 were performed as in Example 1. The piezoelectric acoustic device of the present example demonstrated to have a fundamental resonant frequency equal to or lower than 1 kHz and sound pressure levels exceeding 90 dB in the wide frequency band from 1 to 10 kHz. Further, it also demonstrated to have high stability against the shock from a fall.

Example 30

As a piezoelectric acoustic device according to Example 30, a piezoelectric acoustic device comprising two piezoelectric actuators was manufactured as in Example 13. The piezoelectric acoustic device according to Example 30 differed from the piezoelectric acoustic device according to Example 13 in the opening size of the sound hole on the support board 3*a*. The sound hole had an opening size of 2 mm by 2 mm in Example 13, whereas, in the present example, it had a length and width of 4 mm by 4 mm.

Figure 48:
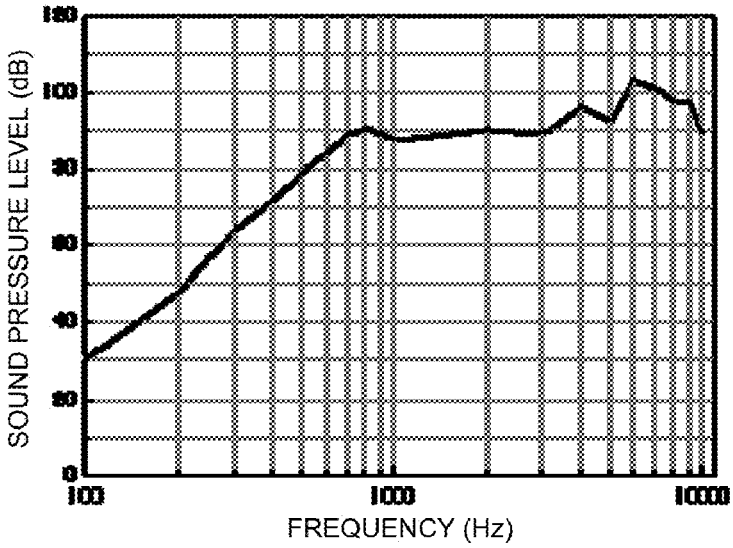
FIG. 48 is a frequency characteristics graph of a piezoelectric acoustic device according to Example 30.

The tests 1 to 3 were performed as in Example 1. FIG. 48 shows an acoustic characteristic graph of the present example showing how the sound pressure changes due to frequency changes. As a result, the piezoelectric acoustic device of the present example demonstrated to have a fundamental resonant frequency equal to or lower than 1 kHz and sound pressure levels exceeding 90 dB in the wide frequency band from 1 to 10 kHz. Further, it also demonstrated to have high stability against the shock from a fall.

Example 31

As a piezoelectric acoustic device according to Example 31, a piezoelectric acoustic device comprising two piezoelectric actuators was manufactured as in Example 13. The piezoelectric acoustic device according to Example 31 differed from the piezoelectric acoustic device according to Example 13 in the opening size of the sound hole on the support board 3*a*. The sound hole had an opening size of 2 mm by 2 mm in Example 13, whereas, in the present example, it had a length and width of 5 mm by 5 mm.

The tests 1 to 3 were performed as in Example 1. As a result, the piezoelectric acoustic device of the present example demonstrated to have a fundamental resonant frequency equal to or lower than 1 kHz and sound pressure levels exceeding 90 dB over most of the frequency band from 1 to 10 kHz. Further, it also demonstrated to have high stability against the shock from a fall.

Example 32

As a piezoelectric acoustic device according to Example 32, a piezoelectric acoustic device comprising two piezoelectric actuators was manufactured as in Example 13. The piezoelectric acoustic device according to Example 32 differed from the piezoelectric acoustic device according to Example 13 in the shape of the sound hole on the support board 3*a*. The sound hole had a square-shaped opening having a length and width of 2 mm by 2 mm in Example 13, whereas, in the present example, it was a circle having a diameter of 2 mm.

The tests 1 to 3 were performed as in Example 1. As a result, the piezoelectric acoustic device of the present example demonstrated to have a fundamental resonant frequency equal to or lower than 1 kHz and sound pressure levels exceeding 90 dB in the wide frequency band from 1 to 10 kHz. Further, it also demonstrated to have high stability against the shock from a fall.

Example 33

As a piezoelectric acoustic device according to Example 33, a piezoelectric acoustic device comprising two piezoelectric actuators was manufactured as in Example 13. The piezoelectric acoustic device according to Example 33 differed from the piezoelectric acoustic device according to Example 13 in the shape of the sound hole on the support board 3*a*. The sound hole had a square-shaped opening having a length and width of 2 mm by 2 mm in Example 13, whereas, in the present example, it was an equilateral triangle having a side length of 2 mm.

The tests 1 to 3 were performed as in Example 1. As a result, the piezoelectric acoustic device of the present example demonstrated to have a fundamental resonant frequency equal to or lower than 1 kHz and sound pressure levels exceeding 90 dB in the wide frequency band from 1 to 10 kHz. Further, it also demonstrated to have high stability against the shock from a fall.

Example 34

As a piezoelectric acoustic device according to Example 34, a piezoelectric acoustic device comprising two piezoelectric actuators was manufactured as in Example 13. The piezoelectric acoustic device according to Example 34 differed from the piezoelectric acoustic device according to Example 13 in the shape of the sound hole on the support board 3*a*. The sound hole had a square-shaped opening having a length and width of 2 mm by 2 mm in Example 13, whereas, in the present example, it was a rectangle of 2 mm by 1 mm.

The tests 1 to 3 were performed as in Example 1. As a result, the piezoelectric acoustic device of the present example demonstrated to have a fundamental resonant frequency equal to or lower than 1 kHz and sound pressure levels exceeding 90 dB over most of the frequency band from 1 to 10 kHz. Further, it also demonstrated to have high stability against the shock from a fall.

Example 35

As an electronic apparatus according to Example 35, the electronic apparatus according to the eighth mode was manufactured. More concretely, the piezoelectric acoustic device according to Example 3 was mounted inside the case of the mobile telephone having two sound holes on the front surface of the case, as shown in FIG. 19, and the acoustic test was performed. Since the piezoelectric acoustic device according to Example 3 did not have any sound hole, the piezoelectric acoustic device was built into the mobile telephone in such a manner that the diaphragm of one of the piezoelectric actuators in the piezoelectric acoustic device faced the sound holes formed on the case of the mobile telephone, as shown in FIG. 20.

Figure 49:
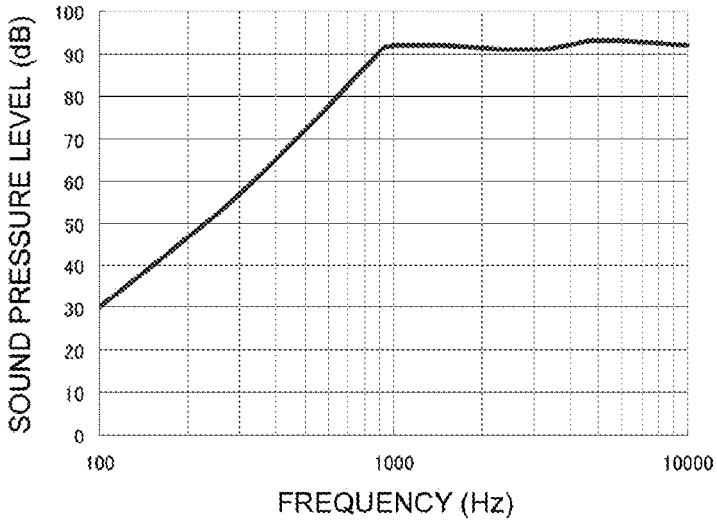
FIG. 49 is a frequency characteristics graph of a piezoelectric acoustic device according to Example 35.

The tests 1 to 3 were performed as in Example 1. FIG. 49 shows an acoustic characteristic graph of the present example showing how the sound pressure changes due to frequency changes. As a result, the mobile telephone of the present example demonstrated to have a fundamental resonant frequency equal to or lower than 1 kHz and sound pressure levels exceeding 90 dB in the wide frequency band from 1 to 10 kHz. Further, in the drop impact test, no crack was observed on the piezoelectric acoustic device even after it was dropped five times. Moreover, the sound pressure level at 1 kHz after the drop impact test was 91 dB.

Example 36

In Example 36, the same tests were performed as in Example 35. Example 36 differed from Example 35 in that the piezoelectric acoustic device according to Example 5 was used. The piezoelectric acoustic device was built into the mobile telephone, as shown in FIG. 20.

Figure 50:
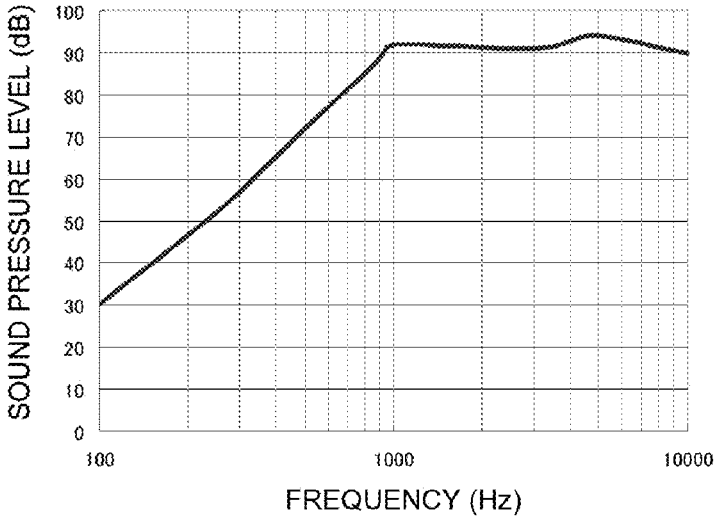
FIG. 50 is a frequency characteristics graph of a piezoelectric acoustic device according to Example 36.

The tests 1 to 3 were performed as in Example 1. FIG. 50 shows an acoustic characteristic graph of the present example showing how the sound pressure changes due to frequency changes. As a result, the mobile telephone of the present example demonstrated to have a fundamental resonant frequency equal to or lower than 1 kHz and sound pressure levels exceeding approximately 90 dB in the wide frequency band from 1 to 10 kHz. Further, in the drop impact test, no crack was observed on the piezoelectric acoustic device even after it was dropped five times. Moreover, the sound pressure level at 1 kHz after the drop impact test was 92 dB.

Example 37

As an electronic apparatus according to Example 37, the electronic apparatus according to the eighth mode was produced. More concretely, the piezoelectric acoustic device according to Example 6 was mounted inside the case of a mobile telephone having two sound holes on the front surface of the case, as shown in FIG. 19, and the acoustic test was performed. Since the piezoelectric acoustic device according to Example 6 had a sound hole, the piezoelectric acoustic device was built into the mobile telephone in such a manner that the sound hole of the piezoelectric acoustic device faced the sound holes formed on the case of the mobile telephone, as shown in FIG. 21.

The tests 1 to 3 were performed as in Example 1. In the drop impact test, no crack was observed on the piezoelectric acoustic device even after it was dropped five times. Further, the sound pressure level at 1 kHz after the drop impact test was 93 dB.

Example 38

In Example 38, the same tests as in Example 35 were performed. In the present example, the piezoelectric acoustic device according to Example 8 was built into a mobile telephone. The piezoelectric acoustic device was built into the mobile telephone as shown in FIG. 20.

The tests 1 to 3 were performed as in Example 1. In the drop impact test, no crack was observed on the piezoelectric acoustic device even after it was dropped five times. Further, the sound pressure level at 1 kHz after the drop impact test was 91 dB.

Example 39

As an electronic apparatus according to Example 39, the electronic apparatus according to the eighth mode was produced. More concretely, the piezoelectric acoustic device according to Example 15 was mounted inside the case of a mobile telephone having two sound holes on the front surface of the case, as shown in FIG. 19, and the acoustic test was performed. The piezoelectric acoustic device according to Example 15 was built into the mobile telephone in such a manner that the diaphragm of one of the piezoelectric actuators in the piezoelectric acoustic device faced the sound holes formed on the case of the mobile telephone, as shown in FIG. 20.

Figure 51:
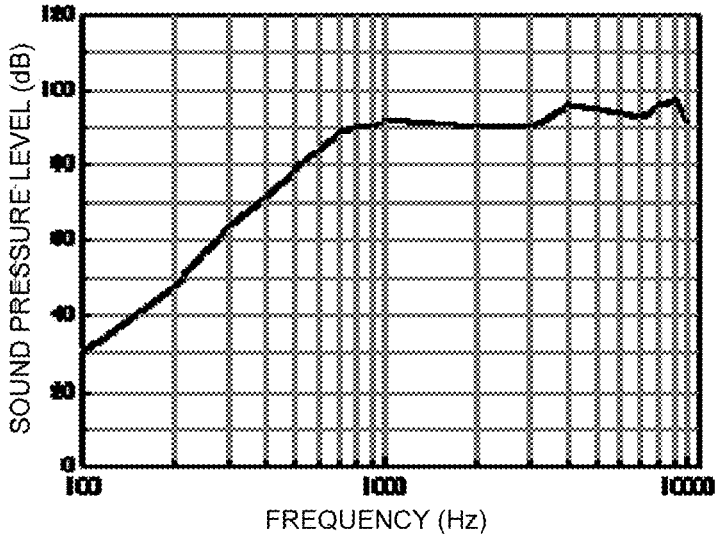
FIG. 51 is a frequency characteristics graph of a piezoelectric acoustic device according to Example 39.

The tests 1 to 3 were performed as in Example 1. FIG. 51 shows an acoustic characteristic graph of the present example showing how the sound pressure changes due to frequency changes. As a result, the mobile telephone of the present example demonstrated to have a fundamental resonant frequency equal to or lower than 1 kHz and sound pressure levels exceeding 90 dB in the wide frequency band from 1 to 10 kHz. Further, in the drop impact test, no crack was observed on the piezoelectric acoustic device even after it was dropped five times. Moreover, the sound pressure level at 1 kHz after the drop impact test was 91 dB.

Example 40

As an electronic apparatus according to Example 40, the electronic apparatus according to the eighth mode was produced. More concretely, the piezoelectric acoustic device according to Example 15 was mounted inside the case of a mobile telephone having two sound holes on the front surface of the case, as shown in FIG. 19, and the acoustic test was performed. The piezoelectric acoustic device according to Example 15 was built into the mobile telephone in such a manner that the sound hole faced the sound holes formed on the case of the mobile telephone, as shown in FIG. 21.

Figure 52:
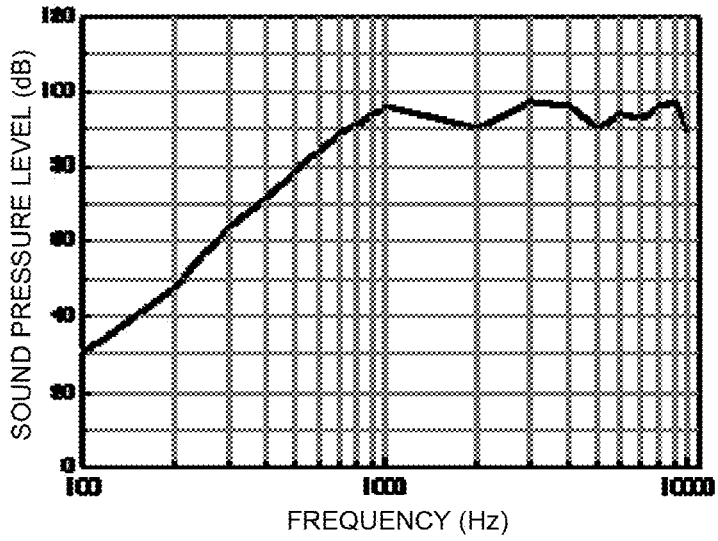
FIG. 52 is a frequency characteristics graph of a piezoelectric acoustic device according to Example 40.

The tests 1 to 3 were performed as in Example 1. FIG. 52 shows an acoustic characteristic graph of the present example showing how the sound pressure changes due to frequency changes. As a result, the mobile telephone of the present example demonstrated to have a fundamental resonant frequency equal to or lower than 1 kHz and sound pressure levels exceeding 90 dB over most of the frequency band from 1 to 10 kHz. Further, in the drop impact test, no crack was observed on the piezoelectric acoustic device even after it was dropped five times. Moreover, the sound pressure level at 1 kHz after the drop impact test was 91 dB.

Example 41

As an electronic apparatus according to Example 41, the electronic apparatus according to the eighth mode was produced. More concretely, the piezoelectric acoustic device according to Example 15 was mounted inside the case of a mobile telephone having two sound holes on the front surface of the case, as shown in FIG. 19, and the acoustic test was performed. The piezoelectric acoustic device according to Example 15 was built into the mobile telephone in such a manner that the diaphragm of one of the piezoelectric actuators in the piezoelectric acoustic device faced the sound holes formed on the case of the mobile telephone, as shown in FIG. 20.

The tests 1 to 3 were performed as in Example 1. As a result, the mobile telephone of the present example demonstrated to have a fundamental resonant frequency equal to or lower than 1 kHz and sound pressure levels exceeding 90 dB in the wide frequency band from 1 to 10 kHz. Further, in the drop impact test, no crack was observed on the piezoelectric acoustic device even after it was dropped five times. Moreover, the sound pressure level at 1 kHz after the drop impact test was 91 dB.

Example 42

As an electronic apparatus according to Example 42, an electronic apparatus in which the piezoelectric acoustic device according to Example 18 was mounted inside the case of a mobile telephone having two sound holes on the front surface of the case, as shown in FIG. 19, was manufactured. The piezoelectric acoustic device according to Example 18 was built into the mobile telephone in such a manner that the sound hole of the piezoelectric acoustic device faced the sound holes formed on the case of the mobile telephone, as shown in FIG. 21.

Figure 53:
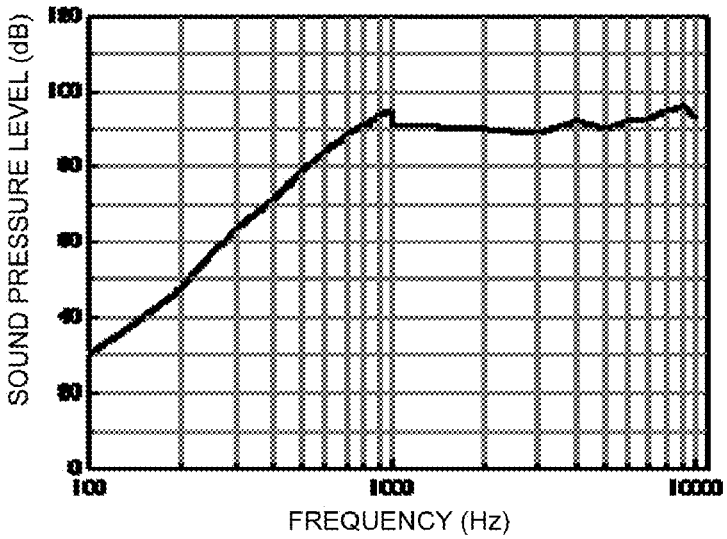
FIG. 53 is a frequency characteristics graph of a piezoelectric acoustic device according to Example 42.

The tests 1 to 3 were performed as in Example 1. FIG. 53 shows an acoustic characteristic graph of the present example showing how the sound pressure changes due to frequency changes. As a result, the mobile telephone of the present example demonstrated to have a fundamental resonant frequency equal to or lower than 1 kHz and sound pressure levels exceeding 90 dB in the wide frequency band from 1 to 10 kHz. Further, in the drop impact test, no crack was observed on the piezoelectric acoustic device even after it was dropped five times. Moreover, the sound pressure level at 1 kHz after the drop impact test was 91 dB.

Example 43

As an electronic apparatus according to Example 43, an electronic apparatus in which the piezoelectric acoustic device according to Example 13 was mounted inside the case of a mobile telephone having sound holes on three surfaces of the case, as shown in FIG. 22, was manufactured. The piezoelectric acoustic device according to Example 13 was built into the mobile telephone in such a manner that the diaphragms of the two piezoelectric actuators and the through hole faced the sound holes formed on the case of the mobile telephone, as shown in FIG. 23.

The tests 1 to 3 were performed as in Example 1. Test 2 was respectively performed from three directions: from the front (main) surface of the display (LCD), the rear surface, and the side surface. As a result, the mobile telephone of the present example demonstrated to have a fundamental resonant frequency equal to or lower than 1 kHz and sound pressure levels exceeding 90 dB in the wide frequency band from 1 to 10 kHz. Further, in the drop impact test, no crack was observed on the piezoelectric acoustic device even after it was dropped five times. Moreover, the sound pressure level at 1 kHz after the drop impact test was 91 dB.

Example 44

As an electronic apparatus according to Example 44, an electronic apparatus in which the piezoelectric acoustic device according to Example 18 was mounted inside the case of a mobile telephone having sound holes on three surfaces of the case, as shown in FIG. 22, was manufactured. The piezoelectric acoustic device according to Example 18 was built into the mobile telephone in such a manner that the diaphragms of the two piezoelectric actuators and the through hole faced the sound holes formed on the case of the mobile telephone, as shown in FIG. 23.

The tests 1 to 3 were performed as in Example 1. The test 2 was respectively performed from three directions: from the front (main) surface of the display (LCD), the rear surface, and the side surface. As a result, the mobile telephone of the present example demonstrated to have a fundamental resonant frequency equal to or lower than 1 kHz and sound pressure levels exceeding 85 dB over most of the frequency band from 1 to 10 kHz. Further, in the drop impact test, no crack was observed on the piezoelectric acoustic device even after it was dropped five times. Moreover, the sound pressure level at 1 kHz after the drop impact test was 91 dB.

Example 45

As an electronic apparatus according to Example 45, an electronic apparatus in which the piezoelectric acoustic device according to Example 20 was mounted inside the case of a mobile telephone having sound holes on three surfaces of the case, as shown in FIG. 22, was manufactured. The piezoelectric acoustic device according to Example 22 was built into the mobile telephone in such a manner that the diaphragms of the two piezoelectric actuators and the through hole faced the sound holes formed on the case of the mobile telephone, as shown in FIG. 23.

The tests 1 to 3 were performed as in Example 1. Test 2 was respectively performed from three directions: from the front (main) surface of the display (LCD), the rear surface, and the side surface. As a result, the mobile telephone of the present example demonstrated to have a fundamental resonant frequency equal to or lower than 1 kHz and sound pressure levels exceeding 90 dB in the wide frequency band from 1 to 10 kHz. Further, in the drop impact test, no crack was observed on the piezoelectric acoustic device even after it was dropped five times. Moreover, the sound pressure level at 1 kHz after the drop impact test was 91 dB.

Example 46

As an electronic apparatus according to Example 46, an electronic apparatus in which the piezoelectric acoustic device according to Example 25 was mounted inside the case of a mobile telephone having sound holes on three surfaces of the case, as shown in FIG. 22, was manufactured. The piezoelectric acoustic device according to Example 25 was built into the mobile telephone in such a manner that the diaphragms of the two piezoelectric actuators and the through hole faced the sound holes formed on the case of the mobile telephone, as shown in FIG. 23.

The tests 1 to 3 were performed as in Example 1. Test 2 was respectively performed from three directions: from the front (main) surface of the display (LCD), the rear surface, and the side surface. As a result, the mobile telephone of the present example demonstrated to have a fundamental resonant frequency equal to or lower than 1 kHz and sound pressure levels exceeding 90 dB in the wide frequency band from 1 to 10 kHz. Further, in the drop impact test, no crack was observed on the piezoelectric acoustic device even after it was dropped five times. Moreover, the sound pressure level at 1 kHz after the drop impact test was 91 dB.

Example 47

As Example 47, a notebook-type personal computer (not shown in the drawings) having the piezoelectric acoustic device according to Example 3 built therein was manufactured. More concretely, the piezoelectric acoustic device was attached to a side surface inside the case of the personal computer as in the cases of the mobile telephone.

The sound pressure level and the frequency characteristics of the notebook-type personal computer were measured with a microphone disposed at a position 30 cm away from the device. Further, the same drop impact test same as test 3 was performed. Note that the notebook-type personal computer having the piezoelectric acoustic device built therein was dropped in the drop impact test.

In the drop impact test, no crack was observed on the piezoelectric acoustic device even after it was dropped five times, and the sound pressure level at 1 kHz after the test was measured to be 92 dB.

Example 48

As Example 48, a notebook-type personal computer (not shown in the drawings) having the piezoelectric acoustic device according to Example 13 built therein was manufactured. More concretely, the piezoelectric acoustic device was attached to a side surface inside the case of the personal computer as in the cases of the mobile telephone. The drop impact test same as test 3 was performed. Note that the notebook-type personal computer having the piezoelectric acoustic device built therein was dropped in the drop impact test.

In the drop impact test, no crack was observed on the piezoelectric acoustic device even after it was dropped five times, and the sound pressure level at 1 kHz after the test was measured to be 92 dB.

Comparative Example 1

Figure 54:
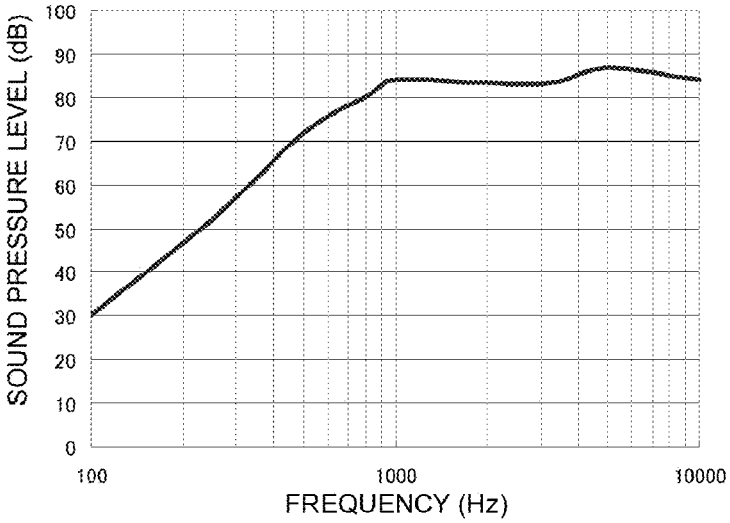
FIG. 54 is a frequency characteristics graph of a piezoelectric acoustic device according to Comparative Example 1.

As Comparative Example 1, one of the piezoelectric actuators used in Example 1 was used as a piezoelectric acoustic device, and tests 1 to 3 same as Example 1 were performed. Note that the material of the diaphragm was polyethylene. FIG. 54 shows an acoustic characteristic graph of Comparative Example 1 showing how the sound pressure changes due to frequency changes. The results show that the piezoelectric acoustic device of Comparative Example 1 cannot provide sound pressure levels exceeding 90 dB in the frequency band of 1 to 10 kHz. In other words, according to the present example, it has turned out that a piezoelectric acoustic device capable of providing higher overall sound pressure levels than Comparative Example 1 can be obtained. Further, when the lowest sound pressure level that can be heard was set to 60 dB, it has turned out that the present example providing higher overall sound pressure levels had a wider frequency band than Comparative Example 1. Therefore, it has been demonstrated that the piezoelectric acoustic device of the present invention has higher sound pressure levels and a wider frequency band.

Comparative Example 2

Figure 55:
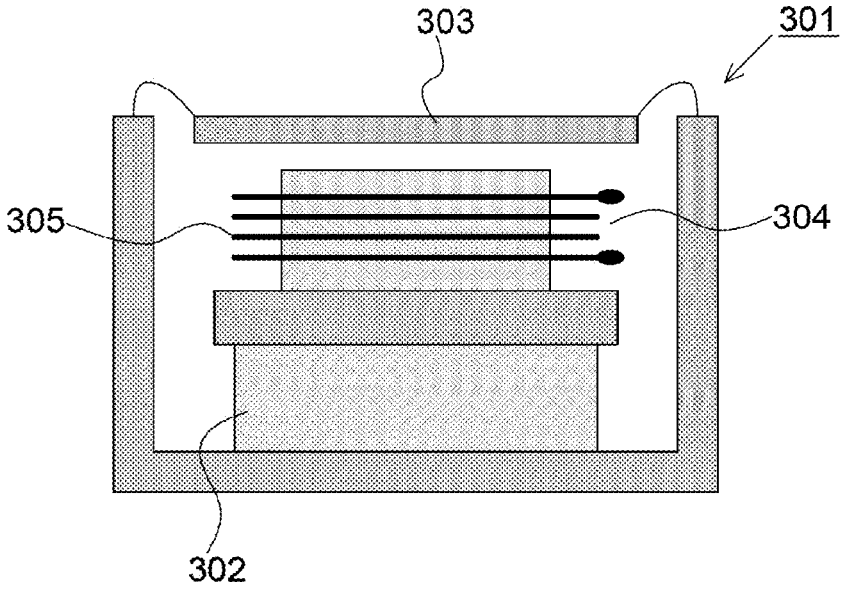
FIG. 55 is a schematic cross-sectional view of an electromagnetic acoustic device according to Comparative Example 2.

As an acoustic device according to Comparative Example 2, an electromagnetic acoustic device 301 as shown in FIG. 55 was manufactured. The acoustic device in FIG. 55 had a permanent magnet 302, a voice coil 304, and a diaphragm 303. When a current flows into the voice coil 304 via an electric terminal 305, a magnetic force occurs, and sound is generated by having the diaphragm 303 repeat suction and repulsion using the generated magnetic force. Further, the outer shape of the acoustic device 301 was circular, and it had an outer diameter of ϕ20 mm and a height of 4.0 mm.

Figure 56:
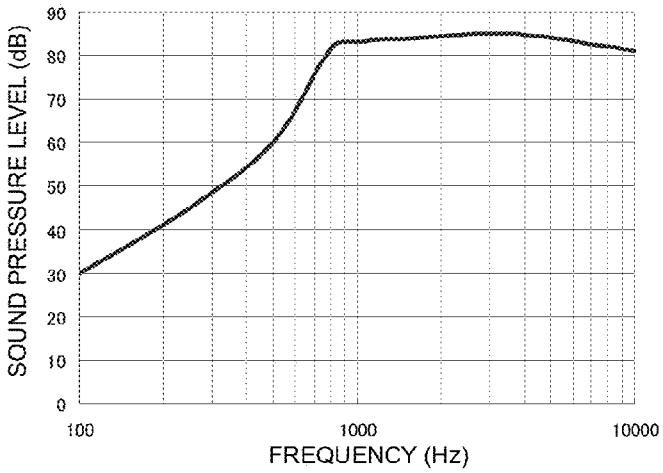
FIG. 56 is a frequency characteristics graph of the electromagnetic acoustic device according to Comparative Example 2.

The sound pressure level and the frequency characteristics of the acoustic device 301 were measured with a microphone disposed at a position 30 cm away from the device. FIG. 56 shows an acoustic characteristic graph of Comparative Example 2 showing how the sound pressure changes due to frequency changes. The results show that the piezoelectric acoustic device of Comparative Example 2 cannot provide sound pressure levels exceeding 85 dB in the frequency band of 1 to 10 kHz. In other words, according to the present example, a piezoelectric acoustic device capable of providing higher overall sound pressure levels than Comparative Example 2 can be obtained. Further, when the lowest sound pressure level that can be heard was set to 60 dB, it becomes obvious that the present example providing higher overall sound pressure levels had a wider frequency band than Comparative Example 2. Therefore, it has been demonstrated that the piezoelectric acoustic device of the present invention had higher sound pressure levels and a wider frequency band.

Comparative Example 3

In Comparative Example 3, the same tests as in Example 35 were performed. In the present compared example, the piezoelectric acoustic device according to Comparative Example 1 was built into the mobile telephone.

Figure 57:
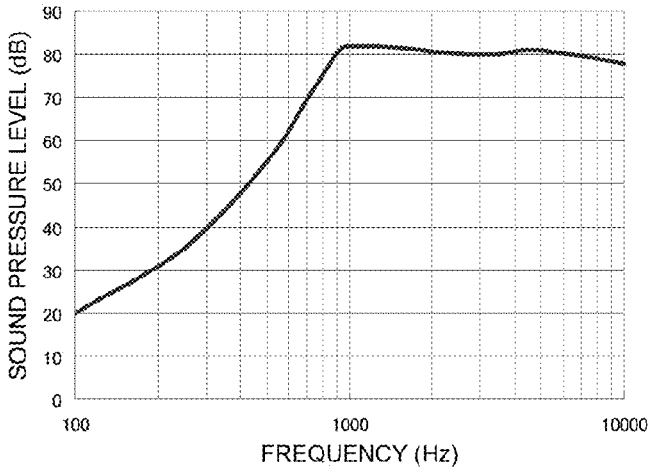
FIG. 57 is a frequency characteristics graph of a piezoelectric acoustic device according to Comparative Example 3.
Figure 58:
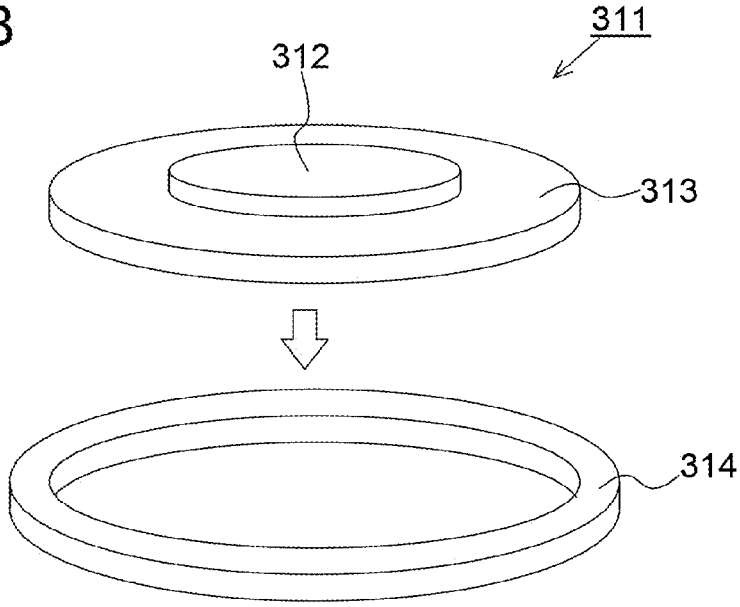
FIG. 58 is a schematic exploded perspective view of a piezoelectric actuator according to a background art.
Figure 59:
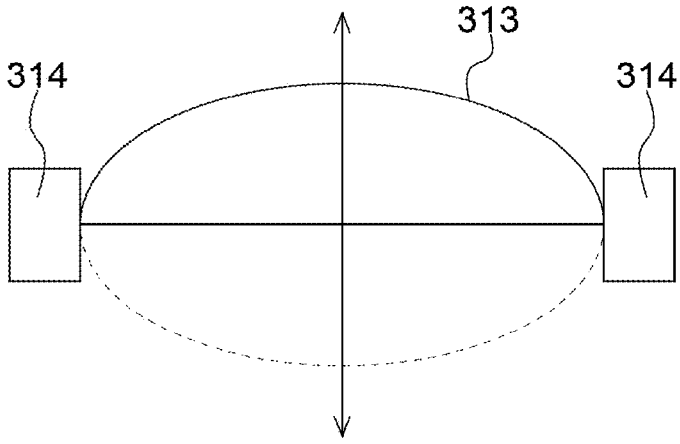
FIG. 59 is a schematic diagram for explaining the operation of the piezoelectric actuator according to the background art.

The tests 1 to 3 were performed as in Example 1. FIG. 57 shows an acoustic characteristic graph of Comparative Example 3 showing how the sound pressure changes due to frequency changes. The results show that the mobile telephone of Comparative Example 3 has sound pressure levels of approximately 80 dB in the frequency band from 1 to 10 kHz, and in some frequency bands, the sound pressure levels are were in the 70 s dB. In other words, according to the present example, an electronic apparatus capable of providing higher overall sound pressure levels than Comparative Example 3 can be obtained. Further, when the lowest sound pressure level that can be heard was set to 60 dB, it has turned out that the present example providing higher overall sound pressure levels had a wider frequency band than Comparative Example 3. Therefore, it has been demonstrated that the electronic apparatus of the present invention had higher sound pressure levels and a wider frequency band. Further, in the drop impact test on Comparative Example 3, a crack was observed after the electronic apparatus was dropped twice, and the sound pressure level at this point was measured to be not higher than 50 dB.

TABLE 1

| | Fundamental resonant frequency/ Hz | Sound pressure level (1 kHz)/ dB | Sound pressure level (3 kHz)/ dB | Sound pressure level (5 kHz)/ dB | Sound pressure level (10 kHz)/ dB | Stability against drop impact |
|---|---|---|---|---|---|---|
| Example 1 | 855 | 98 | 100 | 107 | 105 | ○ |
| Example 2 | 840 | 95 | 98 | 104 | 103 | ○ |
| Example 3 | 845 | 93 | 94 | 99 | 99 | ○ |
| Example 4 | 910 | 95 | 94 | 97 | 96 | ○ |
| Example 5 | 980 | 99 | 97 | 95 | 94 | ○ |
| Example 6 | 820 | 92 | 95 | 97 | 98 | ○ |
| Example 7 | 810 | 93 | 94 | 98 | 99 | ○ |
| Example 8 | 840<br>750 | 94 | 99 | 104 | 95 | ○ |
| Example 9 | 840<br>650 | 98 | 97 | 97 | 97 | ○ |
| Example 10 | 990 | 102 | 95 | 96 | 93 | ○ |
| Example 11 | 925 | 97 | 105 | 108 | 97 | ○ |
| Example 12 | 975 | 103 | 110 | 104 | 102 | ○ |

TABLE 2

| | Fundamental resonant frequency/ Hz | Sound pressure level (1 kHz)/ dB | Sound pressure level (3 kHz)/ dB | Sound pressure level (5 kHz)/ dB | Sound pressure level (10 kHz)/ dB | Stability against drop impact |
|---|---|---|---|---|---|---|
| Example 13 | 845 | 93 | 94 | 99 | 99 | ○ |
| Example 14 | 910 | 95 | 94 | 97 | 96 | ○ |

TABLE 2-continued

| | Fundamental resonant frequency/ Hz | Sound pressure level (1 kHz)/ dB | Sound pressure level (3 kHz)/ dB | Sound pressure level (5 kHz)/ dB | Sound pressure level (10 kHz)/ dB | Stability against drop impact |
|---|---|---|---|---|---|---|
| Example 15 | 980 | 99 | 97 | 95 | 94 | ○ |
| Example 16 | 820 | 92 | 95 | 97 | 98 | ○ |
| Example 17 | 835 | 93 | 94 | 98 | 99 | ○ |
| Example 18 | 840<br>750 | 94 | 99 | 104 | 95 | ○ |
| Example 19 | 840<br>650 | 98 | 97 | 97 | 97 | ○ |
| Example 20 | 820 | 91 | 87 | 91 | 87 | ○ |
| Example 21 | 815 | 87 | 84 | 92 | 91 | ○ |
| Example 22 | 800 | 85 | 86 | 91 | 84 | ○ |
| Example 23 | 860 | 94 | 96 | 102 | 101 | ○ |
| Example 24 | 865 | 98 | 92 | 88 | 94 | ○ |
| Example 25 | 890 | 105 | 97 | 106 | 94 | ○ |
| Example 26 | 840 | 92 | 93 | 100 | 98 | ○ |
| Example 27 | 825 | 94 | 91 | 97 | 99 | ○ |
| Example 28 | 810 | 90 | 92 | 96 | 95 | ○ |
| Example 29 | 830 | 91 | 90 | 95 | 93 | ○ |
| Example 30 | 805 | 87 | 89 | 92 | 89 | ○ |
| Example 31 | 800 | 86 | 91 | 93 | 95 | ○ |
| Example 32 | 860 | 97 | 98 | 92 | 103 | ○ |
| Example 33 | 855 | 94 | 97 | 91 | 106 | ○ |
| Example 34 | 870 | 98 | 92 | 89 | 87 | ○ |

TABLE 3

| | | Fundamental resonant frequency/ Hz | Sound pressure level (1 kHz)/ dB | Sound pressure level (3 kHz)/ dB | Sound pressure level (5 kHz)/ dB | Sound pressure level (10 kHz)/ dB | Stability against drop impact |
|---|---|---|---|---|---|---|---|
| Example 35 | | 830 | 92 | 91 | 93 | 92 | ○ |
| Example 36 | | 875 | 92 | 91 | 94 | 90 | ○ |
| Example 37 | | 855 | 93 | 94 | 94 | 92 | ○ |
| Example 38 | | 720 | 91 | 95 | 99 | 101 | ○ |
| Example 39 | | 810 | 92 | 90 | 95 | 91 | ○ |
| Example 40 | | 820 | 96 | 97 | 90 | 89 | ○ |
| Example 41 | | 840 | 90 | 92 | 94 | 90 | ○ |
| Example 42 | | 825 | 91 | 89 | 87 | 93 | ○ |
| Example 43 | Front | 845 | 93 | 94 | 99 | 99 | ○ |
| | Rear | 845 | 93 | 94 | 99 | 99 | |
| | Side | 845 | 93 | 94 | 99 | 99 | |
| Example 44 | Front | 830 | 83 | 85 | 89 | 97 | ○ |
| | Rear | 810 | 84 | 87 | 94 | 101 | |
| | Side | 805 | 82 | 94 | 87 | 89 | |
| Example 45 | Front | 795 | 85 | 84 | 87 | 90 | ○ |
| | Rear | 770 | 83 | 86 | 88 | 93 | |
| | Side | 765 | 87 | 84 | 84 | 88 | |
| Example 46 | Front | 860 | 94 | 89 | 95 | 101 | ○ |
| | Rear | 845 | 93 | 88 | 92 | 89 | |
| | Side | 850 | 91 | 92 | 94 | 94 | |
| Example 47 | | 815 | 92 | 90 | 93 | 91 | ○ |

TABLE 4

| | Fundamental resonant frequency/ Hz | Sound pressure level (1 kHz)/ dB | Sound pressure level (3 kHz)/ dB | Sound pressure level (5 kHz)/ dB | Sound pressure level (10 kHz)/ dB | Stability against drop impact |
|---|---|---|---|---|---|---|
| Compared Example 1 | 840 | 84 | 83 | 87 | 84 | ○ |
| Compared Example 2 | 810 | 83 | 85 | 84 | 81 | — |
| Compared Example 3 | 850 | 82 | 80 | 81 | 78 | X |

Conclusion

The piezoelectric acoustic devices of Examples 1 to 12 show frequency characteristics close to the frequency characteristics of Comparative Example 2 (electromagnetic actuator) and have high sound pressure levels in the wide frequency band from 1 to 10 kHz. Meanwhile, the frequency characteristics graph of the conventional piezoelectric actuator of Comparative Example 1 shows severe unevenness. This proves that the frequency characteristics of the acoustic device are improved according to the present invention. Further, it has been demonstrated that the acoustic device according to the present invention has a wider frequency band and higher sound pressure levels. Moreover, the sound pressure levels of the mobile telephones having the acoustic devices built therein in Examples 35 to 46 are improved, compared to Comparative Example 3.

Industrial Applicability

The piezoelectric acoustic device according to the present invention can be used as the sound source of an electronic apparatus (for instance, mobile telephone, notebook-type personal computer, and small-size game apparatus).

It should be noted that other objects, features and aspects of the present invention will become apparent in the entire disclosure and that modifications may be done without departing the gist and scope of the present invention as disclosed herein and claimed as appended herewith.

Also it should be noted that any combination of the disclosed and/or claimed elements, matters and/or items may fall under the modifications aforementioned.

What is claimed is:

1. A piezoelectric acoustic device comprising:

at least two piezoelectric actuators;

a support body that supports said at least two piezoelectric actuators; and a signal input unit that drives said at least two piezoelectric actuators at respective arbitrary times; wherein at least one pair of piezoelectric actuators among said at least two piezoelectric actuators is arranged in such a manner that their sound radiation surfaces face each other with a predetermined gap;

said support body includes an integrated plate-like support board; and said at least two piezoelectric actuators and said integrated plate-like support board surround a space defined by said at least one pair of piezoelectric actuators facing each other.

2. The piezoelectric acoustic device as defined in claim 1, wherein one of said piezoelectric actuators includes:

at least one plate-like piezoelectric element that expands and contracts along the sound radiation surface;

a base joined to one side of said piezoelectric element; and a diaphragm joined to said base and having a lower elasticity and a wider area than said base; and said base transmits the expansion/contraction of said piezoelectric element to said diaphragm so as to generate sound waves.

3. The piezoelectric acoustic device as defined in claim 2, wherein said diaphragm and said support body are joined together.

4. The piezoelectric acoustic device as defined in claim 2, wherein said piezoelectric actuator further includes a support member joined to an outer periphery of said diaphragm; and said support member and said support body are joined together.

5. The piezoelectric acoustic device as defined in claim 2, wherein said piezoelectric actuator further includes a support member joined to an outer periphery of said diaphragm; and said support member and said support body are formed as one body.

6. The piezoelectric acoustic device as defined in claim 1, wherein said integrated plate-like support board has a through hole that leads to the space defined by said at least one pair of piezoelectric actuators facing each other.

7. The piezoelectric acoustic device as defined in claim 1, having a rectangular parallelepiped formed by said piezoelectric actuators and said support body, wherein said at least one pair of piezoelectric actuators is disposed on two facing faces of the rectangular parallelepiped; and said piezoelectric actuators or a part of said support body is disposed on the remaining four faces.

8. The piezoelectric acoustic device as defined in claim 1, wherein said piezoelectric actuators included in said at least one pair of piezoelectric actuators have frequency characteristics different from each other.

9. The piezoelectric acoustic device as defined in claim 1, wherein one of said piezoelectric actuators is of a bimorph type having at least two piezoelectric elements.

10. A piezoelectric acoustic device comprising:

at least two piezoelectric actuators;

a support body, including an integrated plate-like support board, that supports said at least two piezoelectric actuators; and a signal input unit that drives said at least two piezoelectric actuators at respective arbitrary times; wherein at least one pair of piezoelectric actuators among said at least two piezoelectric actuators is arranged in such a manner that their sound radiation surfaces face each other with a predetermined gap; and said signal input unit synchronizes operations of said at least two piezoelectric actuators so that a space surrounded by said at least two piezoelectric actuators simultaneously expands or contracts.

11. An electronic apparatus comprising:

a piezoelectric acoustic device, wherein said piezoelectric acoustic device includes:

at least two piezoelectric actuators;

a support body, including an integrated plate-like support board, that supports said at least two piezoelectric actuators; and a signal input unit that drives said at least two piezoelectric actuators at respective arbitrary times; and wherein at least one pair of piezoelectric actuators among said at least two piezoelectric actuators is arranged in such a manner that their sound radiation surfaces face each other with a predetermined gap.

12. The electronic apparatus as defined in claim 11 further comprising a case, wherein said piezoelectric acoustic device is built therein so that at least one piezoelectric actuator faces said case.

13. The electronic apparatus as defined in claim 11 further comprising a case, wherein said piezoelectric acoustic device is built therein so that said piezoelectric actuator does not contact said case.

14. The electronic apparatus as defined in claim 13, wherein said case has at least one through hole that penetrates said case;

said at least two piezoelectric actuators and said integrated plate-like support board surround a space defined by said at least one pair of piezoelectric actuators facing each other;

said integrated plate-like support board has a through hole that leads to the space defined by said at least one pair of piezoelectric actuators facing each other; and said piezoelectric acoustic device is mounted so that said through hole of said case and said through hole of said integrated plate-like support board face each other.

* * * * *